US012800202B2

(12) United States Patent
Kimura et al.

(10) Patent No.: US 12,800,202 B2
(45) Date of Patent: Nov. 17, 2026

(54) HEAT SOURCE UNIT AND REFRIGERATION APPARATUS

(71) Applicant: DAIKIN INDUSTRIES, LTD., Osaka (JP)

(72) Inventors: Naoto Kimura, Osaka (JP); Masaaki Takegami, Osaka (JP); Akitoshi Ueno, Osaka (JP); Tetsuya Shirasaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 86 days.

(21) Appl. No.: 19/080,942

(22) Filed: Mar. 17, 2025

(65) Prior Publication Data

US 2025/0207830 A1 Jun. 26, 2025

Related U.S. Application Data

(63) Continuation of application No. PCT/JP2023/032846, filed on Sep. 8, 2023.

(30) Foreign Application Priority Data

Sep. 20, 2022 (JP) ..... 2022-148785

(51) Int. Cl.
*F25B 41/33* (2021.01)

(52) U.S. Cl.
CPC ..... *F25B 41/33* (2021.01); *F25B 2600/2513* (2013.01)

(58) Field of Classification Search
CPC ..... F25B 9/00; F25B 41/33; F25B 2600/2513
See application file for complete search history.

(56) References Cited

U.S. PATENT DOCUMENTS

2022/0146172 A1 5/2022 Taguchi et al.
2023/0140815 A1 5/2023 Takegami et al.

FOREIGN PATENT DOCUMENTS

JP 2021-032512 A 3/2021
JP 2022-011445 A 1/2022

OTHER PUBLICATIONS

Extended European search report issued on Nov. 5, 2025, in corresponding European patent Application No. 23868072.2, 5 pages.
International Preliminary Report on Patentability (Chapter I) mailed on Apr. 3, 2025, in corresponding PCT/JP2023/032846, 6 pages.
International Search Report and Written Opinion mailed on Nov. 7, 2023, received for PCT Application PCT/JP2023/032846, filed on Sep. 8, 2023, 10 pages including English Translation.

*Primary Examiner* — Jonathan Bradford
(74) *Attorney, Agent, or Firm* — XSENSUS LLP

(57) ABSTRACT

The heat source unit includes a refrigerant control valve and a controller. If the opening degree of the refrigerant control valve changes, the high pressure of the refrigeration cycle changes. The controller adjusts the opening degree of the refrigerant control valve in a stepwise manner. The amount of change by one step in the opening degree of the refrigerant control valve is the unit change amount. The physical quantity indicating the high pressure of the refrigeration cycle is the high pressure index. The controller changes the unit change amount employed when the high pressure index is higher than the reference value to a value lower than the unit change amount employed when the high pressure index is lower than the reference value.

12 Claims, 16 Drawing Sheets

REFRIGERATION FACILITY OPERATION

COOLING AND REFRIGERATION-FACILITY OPERATION

SOLAR HEATING AND DEFROSTING MODE (OPERATION EXAMPLE)

SOLID-STATE AND REFRIGERANT-FACILITY OPERATION
HEAT RECOVERY

HEAT PUMP AND REFRIGERATION SYSTEM
(HEAT PUMP)

HEAT SOURCE UNIT AND REFRIGERATION APPARATUS

CROSS-REFERENCE TO RELATED APPLICATIONS

This application is a continuation of International Application No. PCT/JP2023/032846, filed on Sep. 8, 2023, which claims priority to Japanese Patent Application No. 2022-148785, filed on Sep. 20, 2022, the entire disclosures of each are hereby incorporated by reference herein.

TECHNICAL FIELD

The present disclosure relates to a heat source unit and a refrigeration apparatus.

BACKGROUND ART

Patent Document 1 discloses a refrigeration apparatus including a heat source unit. This refrigeration apparatus performs a refrigeration cycle by circulating a refrigerant between the heat source unit and the utilization-side unit. In the refrigeration cycle performed by this refrigeration apparatus, the high pressure may be higher than the critical pressure of the refrigerant.

CITATION LIST

Patent Document

Patent Document 1: Japanese Unexamined Patent Publication No. 2021-32512

SUMMARY

A first aspect of the present disclosure is directed to a heat source unit connected to a utilization-side unit and configured to perform a refrigeration cycle by circulating a refrigerant between the heat source unit and the utilization-side unit, the heat source unit comprising: a compressor; a heat-source-side heat exchanger; a refrigerant control valve of which an opening degree is variable to control a flow of the refrigerant, where if the opening degree is changed, a high pressure of the refrigeration cycle changes; and a controller configured to change the opening degree of the refrigerant control valve in a stepwise manner, wherein an amount of change by one step in the opening degree of the refrigerant control valve obtained when the controller controls the refrigerant control valve is a unit change amount, a physical quantity indicating the high pressure of the refrigeration cycle is a high pressure index, a value of the high pressure index indicating that the high pressure of the refrigeration cycle is higher than a critical pressure of the refrigerant is a reference value, and the controller changes the unit change amount employed when the high pressure index is higher than the reference value to a value lower than the unit change amount employed when the high pressure index is lower than the reference value.

DESCRIPTION OF EMBODIMENTS

First Embodiment

A first embodiment will be described below.

A refrigeration apparatus (1) according to an embodiment performs cooling of an object to be cooled and air-conditioning of an indoor space in parallel. The object to be cooled herein includes air in facilities such as a refrigerator, a freezer, and a show case. Hereinafter, such facilities are each referred to as a refrigeration facility.

(1) General Configuration

Figure 1:
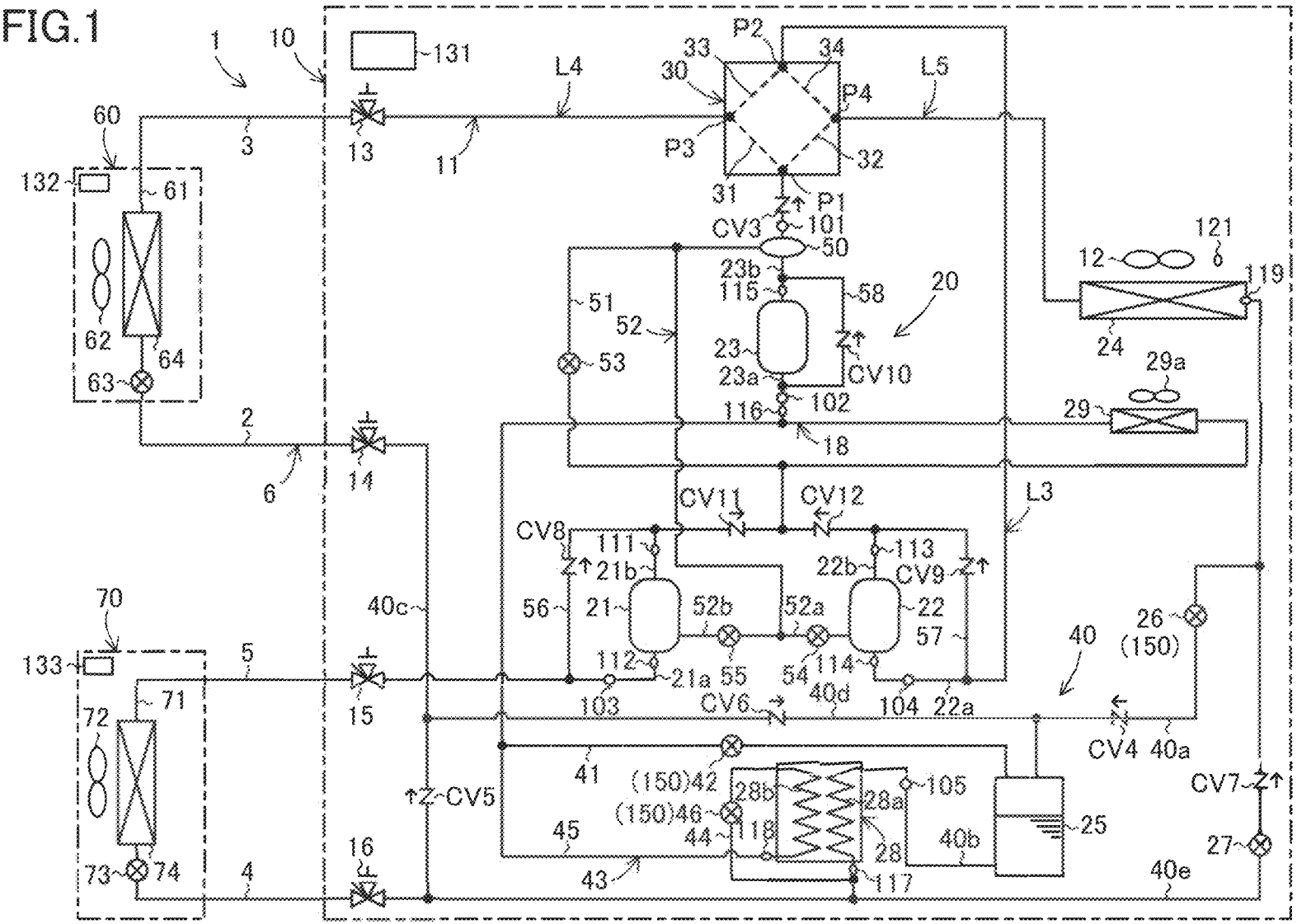
FIG. 1 is a piping system diagram of a refrigeration apparatus of a first embodiment.

As illustrated in FIG. 1, the refrigeration apparatus (1) includes a heat source unit (10) placed outside, an air-conditioning unit (60) configured to perform air-conditioning of an indoor space, and a refrigeration-facility unit (70) configured to cool inside air. FIG. 1 shows a single air-conditioning unit (60). The refrigeration apparatus (1) may include two or more air-conditioning units (60) connected to each other in parallel. FIG. 1 shows a single refrigeration-facility unit (70). The refrigeration apparatus (1) may include two or more refrigeration-facility units (70) connected to each other in parallel.

The refrigeration apparatus (1) includes four connection pipes (2, 3, 4, 5) for connecting the heat source unit (10), the air-conditioning unit (60), and the refrigeration-facility unit (70). In the refrigeration apparatus (1), the heat source unit (10), the air-conditioning unit (60), and the refrigeration-facility unit (70) are connected by the connection pipes (2, 3, 4, 5), thereby forming a refrigerant circuit (6).

The refrigerant circuit (6) is filled with a refrigerant. The refrigerant circuit (6) circulates the refrigerant to perform a refrigeration cycle. The refrigerant of this embodiment is carbon dioxide. The refrigerant circuit (6) performs the refrigeration cycle so that the refrigerant has a pressure equal to or greater than a critical pressure. The refrigerant may be a natural refrigerant other than carbon dioxide.

(1-1) Connection Pipe

The four connection pipes (2, 3, 4, 5) include a first liquid connection pipe (2), a first gas connection pipe (3), a second liquid connection pipe (4), and a second gas connection pipe (5). The first liquid connection pipe (2) and the first gas connection pipe (3) correspond to the air-conditioning unit (60). The second liquid connection pipe (4) and the second gas connection pipe (5) correspond to the refrigeration-facility unit (70).

(2) Heat Source Unit

The heat source unit (10) includes a heat source circuit (11) and an outdoor fan (12). The heat source circuit (11) includes a compression unit (20), an outdoor heat exchanger (24), and a receiver (25). The heat source circuit (11) includes a first outdoor expansion valve (26) and a second outdoor expansion valve (27). The heat source circuit (11) also includes a subcooling heat exchanger (28) and an intercooler (29).

The heat source circuit (11) includes four shut-off valves (13, 14, 15, 16). The four shut-off valves include a first gas shut-off valve (13), a first liquid shut-off valve (14), a second gas shut-off valve (15), and a second liquid shut-off valve (16).

The first gas shut-off valve (13) is connected with the first gas connection pipe (3). The first liquid shut-off valve (14) is connected with the first liquid connection pipe (2). The second gas shut-off valve (15) is connected with the second gas connection pipe (5). The second liquid shut-off valve (16) is connected with the second liquid connection pipe (4).

The heat source unit (10) includes a flow path switching mechanism (30). In the piping system diagram of the refrigerant circuit (6) in e.g., FIG. 1, the detailed illustration of the flow path switching mechanism (30) is omitted. The flow path switching mechanism (30) switches the flow path of a refrigerant in the refrigerant circuit (6). The flow path switching mechanism (30) will be described in detail later.

(2-1) Compression Unit

The compression unit (20) compresses a refrigerant. The compression unit (20) includes a first compressor (21), a second compressor (22), and a third compressor (23). The compression unit (20) performs an operation for compressing a refrigerant in a single stage and an operation for compressing a refrigerant in two stages.

The first compressor (21) is a refrigeration-facility compressor corresponding to the refrigeration-facility unit (70). The first compressor (21) is an example of a first compression element. The second compressor (22) is an air-conditioning compressor corresponding to the air-conditioning unit (60). The second compressor (22) is an example of a second compression element. The first compressor (21) and the second compressor (22) are lower-stage compressors. The first compressor (21) and the second compressor (22) are connected in parallel.

The third compressor (23) is a higher-stage compressor. The third compressor (23) is connected in series to the first compressor (21). The third compressor (23) is connected in series to the second compressor (22).

The first compressor (21), the second compressor (22), and the third compressor (23) are rotary-type compressors, each of which includes a compression mechanism driven by a motor. The first compressor (21), the second compressor (22), and the third compressor (23) are variable-capacity-type compressors. The number of rotations of the motors of the first compressor (21), the second compressor (22), and the third compressor (23) is adjusted by an inverter device. In other words, the operating capacities of the first compressor (21), the second compressor (22), and the third compressor (23) are adjustable.

The first compressor (21) is connected with a first suction pipe (21*a*) and a first discharge pipe (21*b*). The second compressor (22) is connected with a second suction pipe (22*a*) and a second discharge pipe (22*b*). The third compressor (23) is connected with a third suction pipe (23*a*) and a third discharge pipe (23*b*).

(2-2) Intermediate Flow Path

The heat source circuit (11) includes an intermediate flow path (18). The intermediate flow path (18) connects the discharge portions of the first compressor (21) and the second compressor (22) with the suction portion of the third compressor (23). The intermediate flow path (18) includes a first discharge pipe (21*b*), a second discharge pipe (22*b*), and a third suction pipe (23*a*).

(2-3) Outdoor Heat Exchanger and Outdoor Fan

The outdoor heat exchanger (24) is an example of a heat-source-side heat exchanger. The outdoor heat exchanger (24) is a fin-and-tube air heat exchanger. The outdoor fan (12) is disposed near the outdoor heat exchanger (24). The outdoor fan (12) transfers outdoor air. The outdoor heat exchanger exchanges heat between a refrigerant flowing therethrough and outdoor air transferred from the outdoor fan (12).

(2-4) Liquid-Side Flow Path

The heat source circuit (11) includes a liquid-side flow path (40). The liquid-side flow path (40) is provided between the liquid-side end of the outdoor heat exchanger (24) and the two liquid shut-off valves (14, 16). The liquid-side flow path (40) includes first to fifth pipes (40*a*, 40*b*, 40*c*, 40*d*, 40*e*).

One end of the first pipe (40*a*) is connected to the liquid-side end of the outdoor heat exchanger (24). The other end of the first pipe (40*a*) is connected to the top of the receiver (25). One end of the second pipe (40*b*) is connected to the bottom of the receiver (25). The other end of the second pipe (40*b*) is connected to the second liquid shut-off valve (16). One end of the third pipe (40*c*) is connected to an intermediate portion of the second pipe (40*b*). The other end of the third pipe (40*c*) is connected to the first liquid shut-off valve (14). One end of the fourth pipe (40*d*) is connected to the first pipe (40*a*) between the first outdoor expansion valve (26) and the receiver (25). The other end of the fourth pipe (40*d*) is connected to an intermediate portion of the third pipe (40*c*). One end of the fifth pipe (40*e*) is connected to the first pipe (40*a*) between the outdoor heat exchanger (24) and the first outdoor expansion valve (26). The other end of the fifth pipe (40*e*) is connected to the second pipe (40*b*) between the receiver (25) and the junction between the second pipe (40*b*) and the third pipe (40*c*).

(2-5) Outdoor Expansion Valve

The first outdoor expansion valve (26) is provided in the first pipe (40*a*). The first outdoor expansion valve (26) is provided in the first pipe (40*a*) between the liquid-side end of the outdoor heat exchanger (24) and the junction between the first pipe (40*a*) and the fourth pipe (40*d*). The first outdoor expansion valve (26) is an example of the first expansion valve. The second outdoor expansion valve (27) is provided in the fifth pipe (40*e*).

The first outdoor expansion valve (26) and the second outdoor expansion valve (27) are expansion valves of which the opening degrees are adjustable. The first outdoor expansion valve (26) and the second outdoor expansion valve (27) are electronic expansion valves each including a valve body and a stepping motor for driving the valve body. The stepping motor rotates by an angle corresponding to the number of input pulses. Thus, the opening degree of each of the first outdoor expansion valve (26) and the second outdoor expansion valve (27) varies by the number of pulses input to the stepping motor.

(2-6) Receiver

The receiver (25) is a hermetically closed container that stores a refrigerant. The receiver (25) separates the gas-liquid two-phase state refrigerant into a gas refrigerant and a liquid refrigerant. A gas layer and a liquid layer are formed inside the receiver (25). The gas layer is formed near the top of the receiver (25). The liquid layer is formed near the bottom of the receiver (25).

(2-7) Venting Pipe

The heat source circuit (11) includes a venting pipe (41). One end of the venting pipe (41) is connected to the top of the receiver (25). The other end of the venting pipe (41) is connected to the intermediate flow path (18). The venting pipe (41) sends the gas refrigerant in the receiver (25) to the third compressor (23) through the intermediate flow path (18).

The venting pipe (41) is provided with a venting valve (42). The venting valve (42) is an example of the third expansion valve. Similarly to the first outdoor expansion valve (26), the venting valve (42) is an electronic expansion valve including a stepping motor. The opening degree of the venting valve (42) varies by the number of pulses input to the stepping motor of the venting valve (42).

(2-8) Subcooling Heat Exchanger

The subcooling heat exchanger (28) includes a first flow path (28*a*) serving as a high-pressure flow path and a second flow path (28*b*) serving as a low-pressure flow path. The subcooling heat exchanger (28) exchanges heat between the refrigerant in the first flow path (28*a*) and the refrigerant in the second flow path (28*b*). In other words, the subcooling heat exchanger (28) cools the refrigerant flowing in the first flow path (28*a*) by the refrigerant flowing in the second flow path (28*b*).

The second flow path (28*b*) is provided in the middle of the injection flow path (43). The injection flow path (43) includes an upstream flow path (44) and a downstream flow path (45). The injection flow path (43) is an example of the injection pipe.

One end of the upstream flow path (44) is connected to a portion of the third pipe (40*c*) upstream of the junction with the fourth pipe (40*d*). The other end of the upstream flow path (44) is connected to the inflow end of the second flow path (28*b*). The upstream flow path (44) is provided with an injection valve (46).

The injection valve (46) is an example of the second expansion valve. Similarly to the first outdoor expansion valve (26), the injection valve (46) is an electronic expansion valve including a stepping motor. The opening degree of the injection valve (46) varies by the number of pulses input to the stepping motor of the injection valve (46).

One end of the downstream flow path (45) is connected to an outflow end of the second flow path (28*b*). The other end of the downstream flow path (45) is connected to the intermediate flow path (18).

(2-9) Intercooler

The intercooler (29) is provided in the intermediate flow path (18). The intercooler (29) is a fin-and-tube air heat exchanger. A cooling fan (29*a*) is disposed near the intercooler (29). The intercooler (29) exchanges heat between the refrigerant flowing therethrough and the outdoor air transferred from the cooling fan (29*a*).

(2-10) Oil Separation Circuit

The heat source circuit (11) includes an oil separation circuit. The oil separation circuit includes an oil separator (50), a first oil return pipe (51), and a second oil return pipe (52).

The oil separator (50) is connected to the third discharge pipe (23*b*). The oil separator (50) separates oil from the refrigerant discharged from the compression unit (20). Inflow ends of the first oil return pipe (51) and the second oil return pipe (52) communicate with the oil separator (50). An outflow end of the first oil return pipe (51) is connected to the intermediate flow path (18). The first oil return pipe (51) is provided with a first oil level control valve (53).

An outflow portion of the second oil return pipe (52) branches into a first branch pipe (52*a*) and a second branch pipe (52*b*). The first branch pipe (52*a*) is connected to an oil reservoir of the first compressor (21). The second branch pipe (52*b*) is connected to an oil reservoir of the second compressor (22). The first branch pipe (52*a*) is provided with a second oil level control valve (54). The second branch pipe (52*b*) is provided with a third oil level control valve (55).

(2-11) Bypass Pipes

The heat source circuit (11) includes a first bypass pipe (56), a second bypass pipe (57), and a third bypass pipe (58). The first bypass pipe (56) is associated with the first compressor (21). The second bypass pipe (57) is associated with the second compressor (22). The third bypass pipe (58) is associated with the third compressor (23).

Specifically, the first bypass pipe (56) directly connects the first suction pipe (21*a*) and the first discharge pipe (21*b*) together. The second bypass pipe (57) directly connects the second suction pipe (22*a*) and the second discharge pipe (22*b*) together. The third bypass pipe (58) directly connects the third suction pipe (23*a*) and the third discharge pipe (23*b*) together.

(2-12) Check Valve

The heat source circuit (11) includes a plurality of check valves. The check valves include first to twelfth check valves (CV1 to CV12). The check valves (CV1 to CV12) allow the flow of a refrigerant in the direction of the arrow in FIG. 1 and disallow the flow of a refrigerant in the reverse direction.

The first check valve (CV1) and the second check valve (CV2) are provided in a flow path switching mechanism (30) described in detail later.

The third check valve (CV3) is provided in the third discharge pipe (23*b*). The fourth check valve (CV4) is provided in the first pipe (40*a*). The fifth check valve (CV5) is provided in the third pipe (40*c*). The sixth check valve (CV6) is provided in the fourth pipe (40*d*). The seventh check valve (CV7) is provided in the fifth pipe (40*e*). The eighth check valve (CV8) is provided in the first bypass pipe (56). The ninth check valve (CV9) is provided in the second bypass pipe (57). The tenth check valve (CV10) is provided in the third bypass pipe (58). The eleventh check valve (CV11) is provided in the first discharge pipe (21*b*). The twelfth check valve (CV12) is provided in the second discharge pipe (22*b*).

(3) Air-Conditioning Unit

The air-conditioning unit (60) is a first utilization unit installed indoors. The air-conditioning unit (60) includes an indoor circuit (61) and an indoor fan (62). The liquid-side end of the indoor circuit (61) is connected with the first liquid connection pipe (2). The gas-side end of the indoor circuit (61) is connected with the first gas connection pipe (3).

The indoor circuit (61) includes an indoor expansion valve (63) and an indoor heat exchanger (64) in the sequence from the liquid-side end to the gas-side end. The indoor expansion valve (63) is an expansion valve of which the opening degree is adjustable. The indoor expansion valve (63) is an electronic expansion valve of which the opening degree is adjusted based on pulse signals.

The indoor heat exchanger (64) is a fin-and-tube air heat exchanger. The indoor heat exchanger (64) is an example of a first utilization-side heat exchanger. The indoor fan (62) is disposed near the indoor heat exchanger (64). The indoor fan (62) transfers indoor air. The indoor heat exchanger (64) exchanges heat between the refrigerant flowing therethrough and the indoor air transferred by the indoor fan (62).

(4) Refrigeration-Facility Unit

The refrigeration-facility unit (70) is a second utilization unit that cools its internal space. The refrigeration-facility unit (70) includes a refrigeration-facility circuit (71) and a refrigeration-facility fan (72). The liquid-side end of the refrigeration-facility circuit (71) is connected with the second liquid connection pipe (4). The gas-side end of the refrigeration-facility circuit (71) is connected with the second gas connection pipe (5).

The refrigeration-facility circuit (71) includes a refrigeration-facility expansion valve (73) and a refrigeration-facility heat exchanger (74) in the sequence from the liquid-side end to the gas-side end. The refrigeration-facility expansion valve (73) is an expansion valve of which the opening degree is adjustable. The refrigeration-facility expansion valve (73) is an electronic expansion valve of which the opening degree is adjusted based on pulse signals.

The refrigeration-facility heat exchanger (74) is a fin-and-tube air heat exchanger. The refrigeration-facility heat exchanger (74) is an example of a second utilization-side heat exchanger. The refrigeration-facility fan (72) is disposed near the refrigeration-facility heat exchanger (74). The refrigeration-facility fan (72) transfers inside air. The refrigeration-facility heat exchanger (74) exchanges heat between the refrigerant flowing therethrough and the inside air transferred by the refrigeration-facility fan (72).

The evaporation temperature of a refrigerant in the refrigeration-facility heat exchanger (74) is lower than the evaporation temperature of a refrigerant in the indoor heat exchanger (64).

(5) Flow Path Switching Mechanism

Figure 3:
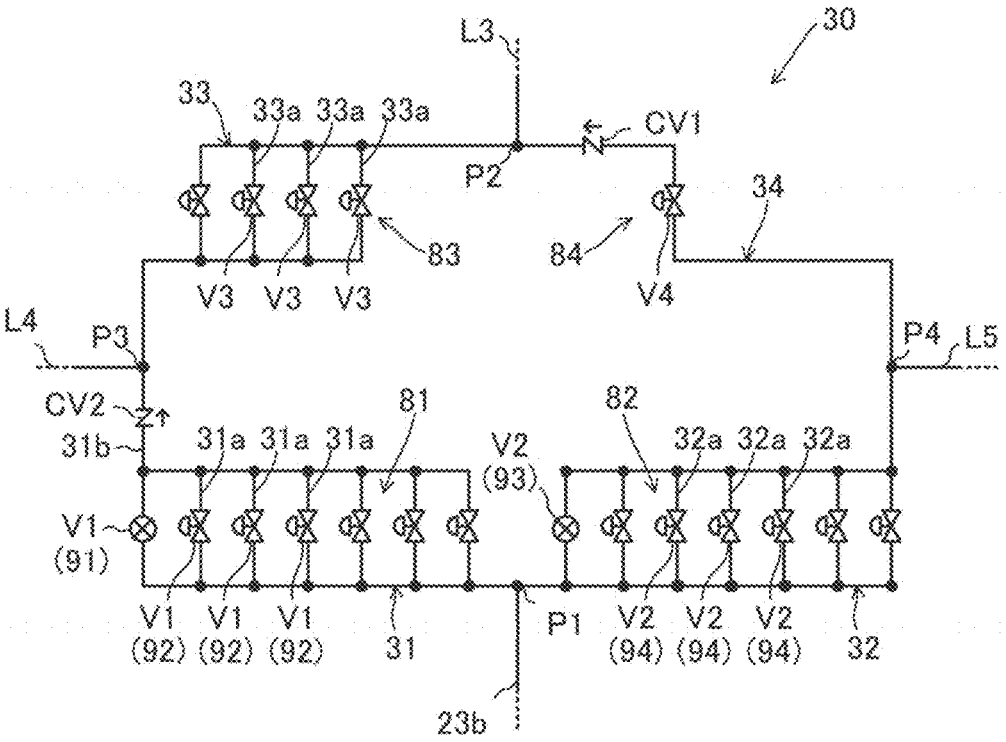
FIG. 3 is a diagram of a flow path switching mechanism.

The flow path switching mechanism (30) is provided in the heat source circuit (11). As illustrated in FIGS. 1 and 3, the flow path switching mechanism (30) includes a first port (P1), a second port (P2), a third port (P3), a fourth port (P4), a first switching flow path (31), a second switching flow path (32), a third switching flow path (33), and a fourth switching flow path (34). The first switching flow path (31) is provided with a first opening/closing mechanism (81); the second switching flow path (32) is provided with a second opening/closing mechanism (82); the third switching flow path (33) is provided with a third opening/closing mechanism (83); and the fourth switching flow path (34) is provided with a fourth opening/closing mechanism (84).

(5-1) Port

The first port (P1) is connected with the discharge portion of the third compressor (23) through the third discharge pipe (23*b*).

The second port (P2) is connected with the suction portion of the second compressor (22) via a suction line (L3). The second port (P2) is not connected with the suction portion of the first compressor (21). The suction line (L3) is a flow path, one end of which is connected with the suction portion of the second compressor (22) and the other end of which is connected with the second port (P2). In other words, the suction line (L3) is a flow path extending from the suction portion of the second compressor (22) to the second port (P2).

The third port (P3) is connected with the gas end portion of the indoor heat exchanger (64). The third port (P3) is connected with the gas end portion of the indoor heat exchanger (64) via a first gas line (L4). The first gas line (L4) is a flow path, one end of which is connected with the indoor heat exchanger (64) and the other end of which is connected with the third port (P3). In other words, the first gas line (L4) is a flow path extending from the gas end portion of the indoor heat exchanger (64) to the third port (P3).

The fourth port (P4) is connected with the gas end portion of the outdoor heat exchanger (24). The fourth port (P4) is connected with the gas end portion of the outdoor heat exchanger (24) via a second gas line (L5). The second gas line (L5) is a flow path, one end of which is connected with the gas end portion of the outdoor heat exchanger (24) and the other end of which is connected with the fourth port (P4). The second gas line (L5) is a flow path extending from the gas end portion of the outdoor heat exchanger (24) to the fourth port (P4).

The suction line (L3), the first gas line (L4), and the second gas line (L5) refer to the flow paths including pipes and elements connected to the pipes.

(5-2) Flow Path

As schematically shown in FIG. 1, the first switching flow path (31), the second switching flow path (32), the third switching flow path (33), and the fourth switching flow path (34) are connected in a bridge shape. The first switching flow path (31) connects the first port (P1) and the third port (P3). The second switching flow path (32) connects the first port (P1) and the fourth port (P4). The third switching flow path (33) connects the second port (P2) and the third port (P3). The fourth switching flow path (34) connects the second port (P2) and the fourth port (P4). The first switching flow path (31) and the second switching flow path (32) are high-pressure flow paths on which high pressure acts. In other words, the first switching flow path (31) and the second switching flow path (32) are discharge flow paths on which the discharge pressure of the compression unit (20) acts. The third switching flow path (33) and the fourth switching flow path (34) are low-pressure flow paths on which low pressure acts. The third switching flow path (33) and the fourth switching flow path (34) are suction flow paths on which the suction pressure of the compression unit (20) acts.

As illustrated in FIG. 3, the first switching flow path (31) includes two or more first branch flow paths (31*a*) provided in parallel with each other. The first switching flow path (31) of this example includes seven first branch flow paths (31*a*). The second switching flow path (32) of this example includes two or more second branch flow paths (32*a*) provided in parallel with each other. The second switching flow path (32) includes seven second branch flow paths (32*a*). The third switching flow path (33) includes third branch flow paths (33*a*) provided in parallel with each other. The third switching flow path (33) of this example includes four third branch flow paths (33*a*). The fourth switching flow path (34) consists of a single flow path.

(5-3) Opening/Closing Mechanism

The first opening/closing mechanism (81) includes a plurality of first on-off valves (V1). The first switching flow path (31) is provided with two or more first on-off valves (V1) provided in parallel. The first switching flow path (31) of this example is provided with seven first on-off valves (V1). Each first branch flow path (31*a*) is provided with one first on-off valve (V1). The first on-off valves (V1) include a first switching expansion valve (91) and a first electromagnetic on-off valve (92). The number of the first switching expansion valves (91) is one, and the number of the first electromagnetic on-off valves (92) is six. The first switching expansion valve (91) is an electronic expansion valve of which the opening degree is variable.

The second opening/closing mechanism (82) includes a plurality of second on-off valves (V2). The second switching flow path (32) is provided with two or more second on-off valves (V2) provided in parallel. The second switching flow path (32) of this example is provided with seven second on-off valves (V2). Each second branch flow path (32*a*) is provided with one second on-off valve (V2). The second on-off valves (V2) include a second switching expansion valve (93) and a second electromagnetic on-off valve (94). The number of the second switching expansion valves (93) is one, and the number of the second electromagnetic on-off valves (94) is six. The second switching expansion valve (93) is an electronic expansion valve of which the opening degree is variable.

The third opening/closing mechanism (83) includes a plurality of third on-off valves (V3). The third switching flow path (33) is provided with two or more third on-off valves (V3) provided in parallel. The third switching flow path (33) of this example is provided with four third on-off valves (V3). Each third branch flow path (33*a*) is provided with one third on-off valve (V3). The third on-off valves (V3) are electromagnetic on-off valves.

The fourth opening/closing mechanism (84) includes one fourth on-off valve (V4). The fourth switching flow path (34) is provided with the fourth on-off valve (V4). The fourth on-off valve (V4) is an electromagnetic on-off valve.

Figure 2:
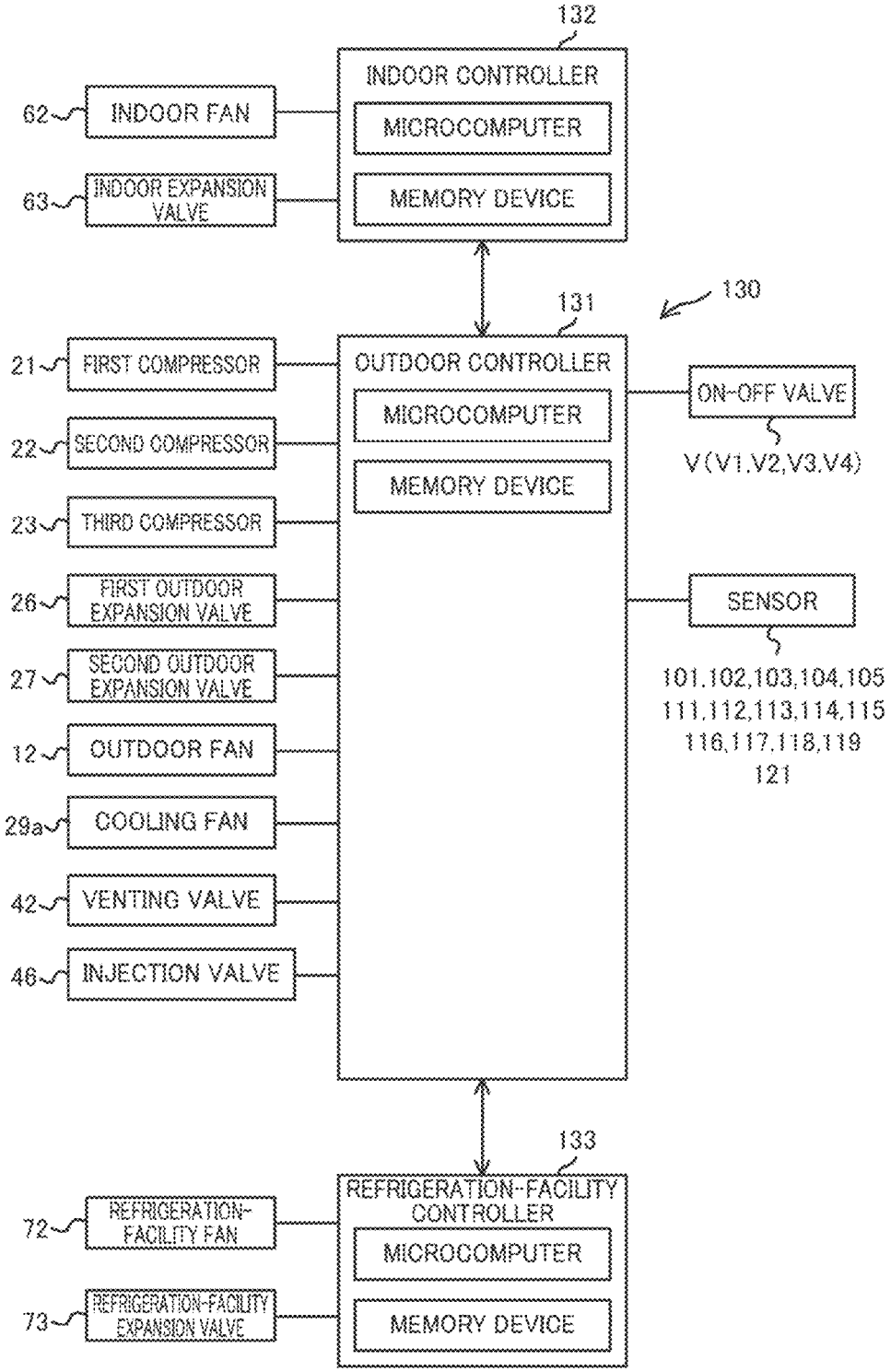
FIG. 2 is a block diagram showing connections between the control system and devices around the control system.

The first on-off valve (V1), the second on-off valve (V2), the third on-off valve (V3), and the fourth on-off valve (V4) may be simply referred to as the on-off valve (V) as shown in FIG. 2.

(5-4) Check Valve

The flow path switching mechanism (30) includes check valves (CV1, CV2). Specifically, the fourth switching flow path (34) is provided with the first check valve (CV1). The first switching flow path (31) is provided with the second check valve (CV2).

The first check valve (CV1) in the fourth switching flow path (34) restricts the flow of a refrigerant from the second port (P2) to the fourth port (P4). More precisely, the first check valve (CV1) in the fourth switching flow path (34) allows the flow of a refrigerant from the fourth port (P4) to the second port (P2) and disallows the flow of a refrigerant from the second port (P2) to the fourth port (P4). The first check valve (CV1) in the fourth switching flow path (34) is provided closer to the second port (P2) than the on-off valve (V) is.

The second check valve (CV2) in the first switching flow path (31) restricts the flow of a refrigerant from the third port (P3) to the first port (P1). More precisely, the second check valve (CV2) in the first switching flow path (31) allows the flow of a refrigerant from the first port (P1) to the third port (P3) and disallows the flow of a refrigerant from the third port (P3) to the first port (P1). The second check valve (CV2) is provided in the main flow path (31*b*) of the first switching flow path (31). The main flow path (31*b*) is a flow path connected with the ends of the first branch flow paths (31*a*). The second check valve (CV2) in the first switching flow path (31) is provided closer to the third port (P3) than the on-off valve (V) is.

(6) Sensor

As illustrated in FIG. 1, the refrigeration apparatus (1) includes a plurality of sensors. The sensors include a refrigerant pressure sensor that detects the pressure of a refrigerant; a refrigerant temperature sensor that detects the temperature of a refrigerant; and an air temperature sensor that detects the temperature of air.

The refrigerant pressure sensors include a high pressure sensor (101), an intermediate pressure sensor (102), a first suction pressure sensor (103), a second suction pressure sensor (104), and a liquid-side pressure sensor (105). The high pressure sensor (101) is provided in the third discharge pipe (23*b*). The high pressure sensor (101) detects the pressure of a refrigerant on the discharge side of the compression unit (20), in other words, detects the high pressure of the refrigerant circuit (6). The intermediate pressure sensor (102) is provided in the third suction pipe (23*a*). The intermediate pressure sensor (102) detects the pressure of a refrigerant between the lower-stage compressor and the higher-stage compressor, in other words, detects the intermediate pressure of the refrigerant circuit (6). The first suction pressure sensor (103) is provided in the first suction pipe (21*a*). The first suction pressure sensor (103) detects the pressure of a refrigerant on the suction side of the first compressor (21). The second suction pressure sensor (104) is provided in the second suction pipe (22*a*). The second suction pressure sensor (104) detects the pressure of a refrigerant on the suction side of the second compressor (22).

The liquid-side pressure sensor (105) is provided in the liquid-side flow path (40). Specifically, the liquid-side pressure sensor (105) is provided in the second pipe (40*b*). The liquid-side pressure sensor (105) detects the pressure corresponding to the internal pressure of the receiver (25). The liquid-side pressure sensor (105) detects the pressure corresponding to the pressure of the refrigerant in the first flow path (28*a*).

The refrigerant temperature sensor includes a first discharge temperature sensor (111), a first suction temperature sensor (112), a second discharge temperature sensor (113), a second suction temperature sensor (114), a third discharge temperature sensor (115), a third suction temperature sensor (116), a liquid-side temperature sensor (117), an injection-side temperature sensor (118), and a heat-source-side temperature sensor (119). The first discharge temperature sensor (111) is provided in the first discharge pipe (21*b*) and detects the temperature of the refrigerant discharged from the first compressor (21). The first suction temperature sensor (112) is provided in the first suction pipe (21*a*) and detects the temperature of the refrigerant sucked into the first compressor (21). The second discharge temperature sensor (113) is provided in the second discharge pipe (22*b*) and detects the temperature of the refrigerant discharged from the second compressor (22). The second suction temperature sensor (114) is provided in the second suction pipe (22*a*) and detects the temperature of the refrigerant sucked into the second compressor (22). The third discharge temperature sensor (115) is provided in the third discharge pipe (23*b*) and detects the temperature of the refrigerant discharged from the third compressor (23). The third suction temperature sensor (116) is provided in the third suction pipe (23*a*) and detects the temperature of the refrigerant sucked into the third compressor (23).

The liquid-side temperature sensor (117) is provided in the liquid-side flow path (40). Specifically, the liquid-side temperature sensor (117) is provided on the outflow side of the first flow path (28*a*) of the subcooling heat exchanger (28) in the liquid-side flow path (40). More specifically, the liquid-side temperature sensor (117) is provided in the liquid-side flow path (40) between the outflow end of the first flow path (28*a*) and the inflow end of the injection flow path (43). The liquid-side temperature sensor (117) detects the temperature of the refrigerant flowing out of the first flow path (28*a*).

The injection-side temperature sensor (118) is provided in the downstream flow path (45) of the injection flow path (43). In other words, the injection-side temperature sensor (118) is provided on the outflow side of the second flow path (28*b*) of the subcooling heat exchanger (28). The injection-side temperature sensor (118) detects the temperature of the refrigerant flowing out of the second flow path (28*b*).

The heat-source-side temperature sensor (119) is provided in the heat transfer tube of the outdoor heat exchanger (24). The heat-source-side temperature sensor (119) is provided at the liquid-side end of the outdoor heat exchanger (24). The heat-source-side temperature sensor (119) detects the temperature of the refrigerant at the liquid-side end of the outdoor heat exchanger (24).

The air temperature sensor includes an outdoor air temperature sensor (121). The outdoor air temperature sensor (121) detects the temperature of outdoor air.

(7) Control System

As illustrated in FIG. 2, the refrigeration apparatus (1) includes a control system (130) configured to control the refrigerant circuit (6). The control system (130) includes an outdoor controller (131), an indoor controller (132), and a refrigeration-facility controller (133). Each of the outdoor controller (131), the indoor controller (132), and the refrigeration-facility controller (133) includes a microcomputer mounted on a control board and a memory device (specifically, a semiconductor memory) storing software for operating the microcomputer.

As illustrated in FIG. 1, the outdoor controller (131) is provided in the heat source unit (10). The indoor controller (132) is provided in the air-conditioning unit (60). The refrigeration-facility controller (133) is provided in the refrigeration-facility unit (70). The outdoor controller (131) is capable of communicating with the indoor controller (132) and the refrigeration-facility controller (133).

The control system (130) receives control commands and detection signals from the sensors. The control system (130) controls each device of the refrigeration apparatus (1). Specifically, the control system (130) controls ON/OFF of the first compressor (21), the second compressor (22), and the third compressor (23). The control system (130) regulates the rotational speed of the first compressor (21), the second compressor (22), and the third compressor (23), thereby regulating the operating capacity of the compression unit (20). The control system (130) controls ON/OFF of each fan (12, 62, 72). The control system (130) adjusts the opening degree of each expansion valve (26, 27, 63). The control system (130) switches the on/off state of each valve (42, 43). The control system (130) switches the on/off state of each on-off valve (V) and adjusts the opening degree of each on-off valve (V).

(8) Operation

The operation of the refrigeration apparatus (1) will be described below. The operation of the refrigeration apparatus (1) includes a refrigeration-facility operation, a cooling operation, a cooling and refrigeration-facility operation, a heating operation, a heating and refrigeration-facility operation, and a defrosting operation. The heating and refrigeration-facility operation includes a first heating and refrigeration-facility operation, a second heating and refrigeration-facility operation, and a third heating and refrigeration-facility operation.

In the refrigeration-facility operation, the refrigeration-facility unit (70) cools inside air, and the air-conditioning unit (60) is stopped. In the cooling operation, the refrigeration-facility unit (70) is stopped, and the air-conditioning unit (60) performs cooling of the indoor space. In the cooling and refrigeration-facility operation, the refrigeration-facility unit (70) cools inside air, and the air-conditioning unit (60) performs cooling of the indoor space. In the heating operation, the refrigeration-facility unit (70) is stopped, and the air-conditioning unit (60) performs heating of the indoor space. In the heating and refrigeration-facility operation, the refrigeration-facility unit (70) cools inside air, and the air-conditioning unit (60) performs heating of the indoor space. In the defrosting operation, the frost on the outdoor heat exchanger (24) is melted.

The first heating and refrigeration-facility operation is an operation in which the heat taken by the refrigerant in the outdoor heat exchanger (24) and the refrigeration-facility heat exchanger (74) is used for heating. The second heating and refrigeration-facility operation is an operation in which the outdoor heat exchanger (24) is deactivated and the heat taken by the refrigerant in the refrigeration-facility heat exchanger (74) is used for heating. The third heating and refrigeration-facility operation is an operation in which the heat of the refrigerant is released from the outdoor heat exchanger (24).

The outline of each operation will be described with reference to FIGS. 4 to 10. In the drawings, the flows of refrigerants are indicated by the broken arrows, and the flow paths through which the refrigerants flow are indicated by the thick lines. In the drawings, the heat exchanger functioning as a radiator is hatched, and the heat exchanger functioning as an evaporator is dotted.

(8-1) Refrigeration-Facility Operation

Figure 4:
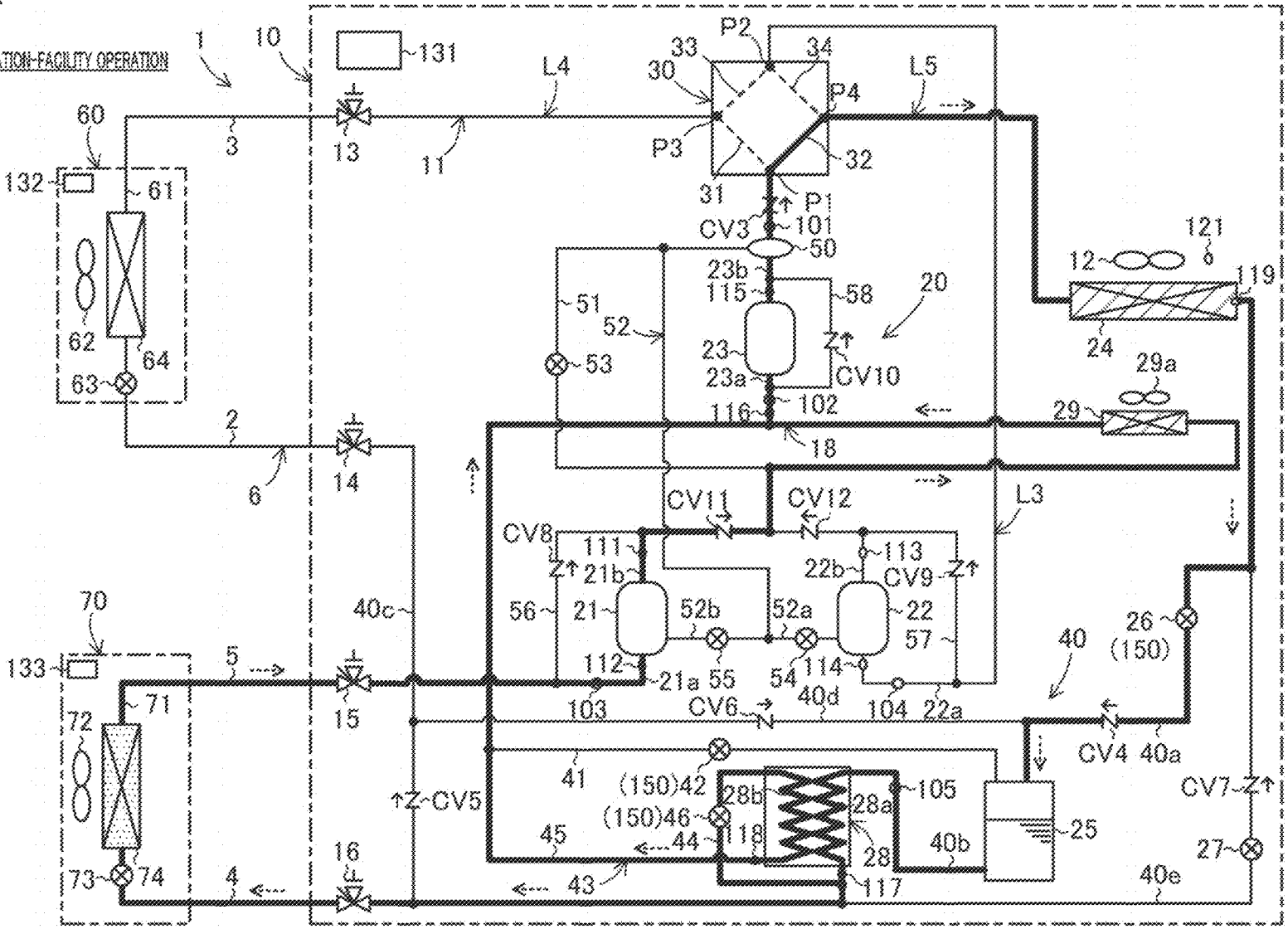
FIG. 4 is a piping system diagram of the refrigeration apparatus and shows the flow of a refrigerant in the refrigeration-facility operation.

In the refrigeration-facility operation shown in FIG. 4, the control system (130) closes the first on-off valve (V1), the third on-off valve (V3), and the fourth on-off valve (V4), and opens the second on-off valve (V2). The control system (130) stops the second compressor (22), and operates the first compressor (21) and the third compressor (23). The control system (130) adjusts the opening degrees of the first outdoor expansion valve (26) and the injection valve (46), and closes the second outdoor expansion valve (27). The control system (130) closes the indoor expansion valve (63), and adjusts the opening degree of the refrigeration-facility expansion valve (73). The control system (130) operates the outdoor fan (12) and the refrigeration-facility fan (72), and stops the indoor fan (62).

In the refrigeration-facility operation, the refrigeration cycle is performed in which the outdoor heat exchanger (24) functions as a radiator, the function of the indoor heat exchanger (64) is substantially deactivated, and the refrigeration-facility heat exchanger (74) functions as an evaporator.

Specifically, the refrigerant having been compressed by the first compressor (21) is cooled in the intercooler (29), and then is sucked into the third compressor (23). The refrigerant having been compressed to a pressure equal to or greater than the critical pressure by the third compressor (23) dissipates heat in the outdoor heat exchanger (24), and then passes through the first outdoor expansion valve (26). The first outdoor expansion valve (26) decompresses the refrigerant to a pressure lower than the critical pressure.

The refrigerant in a subcritical state flows into the receiver (25). The receiver (25) separates the refrigerant into a gas refrigerant and a liquid refrigerant.

The liquid refrigerant separated by the receiver (25) is cooled in the subcooling heat exchanger (28) by the refrigerant flowing through the injection flow path (43). The refrigerant in the injection flow path (43) is sent to the intermediate flow path (18).

The refrigerant having been cooled by the subcooling heat exchanger (28) is sent to the refrigeration-facility unit (70). The refrigerant sent to the refrigeration-facility unit (70) is decompressed by the refrigeration-facility expansion valve (73), and then evaporates in the refrigeration-facility heat exchanger (74). As a result, the inside air is cooled. The refrigerant having evaporated in the refrigeration-facility heat exchanger (74) is sucked into and compressed again by the first compressor (21).

(8-2) Cooling Operation

Figure 5:
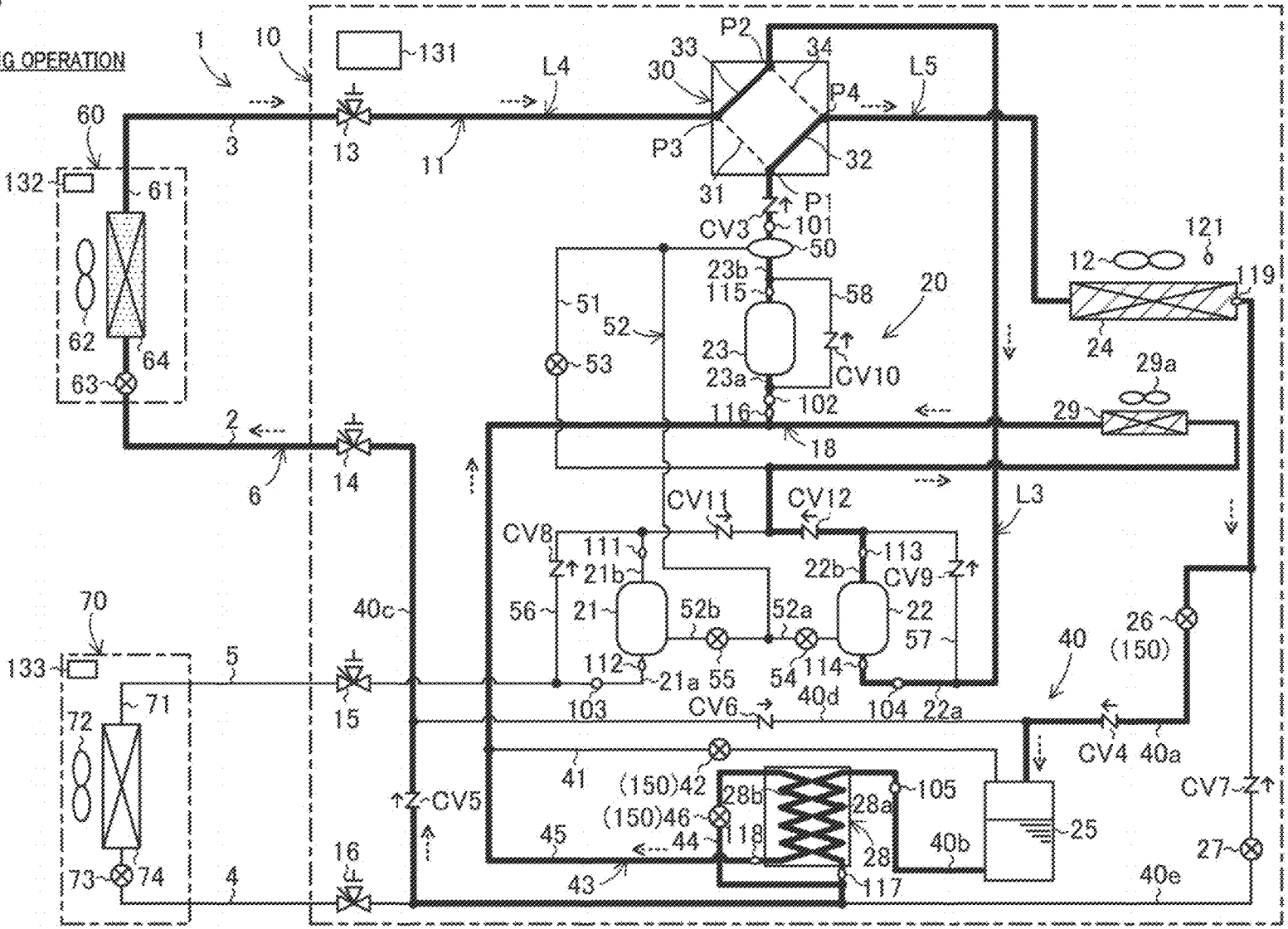
FIG. 5 is a piping system diagram of the refrigeration apparatus and shows the flow of a refrigerant in the cooling operation (the defrosting operation).

In the cooling operation shown in FIG. 5, the control system (130) closes the first on-off valve (V1) and the fourth on-off valve (V4), and opens the second on-off valve (V2) and the third on-off valve (V3). The control system (130) stops the first compressor (21), and operates the second compressor (22) and the third compressor (23). The control system (130) adjusts the opening degrees of the first outdoor expansion valve (26), the injection valve (46), and the venting valve (42), and closes the second outdoor expansion valve (27). The control system (130) closes the refrigeration-facility expansion valve (73), and adjusts the opening degree of the indoor expansion valve (63). The control system (130) operates the outdoor fan (12) and the indoor fan (62), and stops the refrigeration-facility fan (72).

In the cooling operation, the refrigeration cycle is performed in which the outdoor heat exchanger (24) functions as a radiator, the indoor heat exchanger (64) functions as an evaporator, and the function of the refrigeration-facility heat exchanger (74) is substantially deactivated.

Specifically, the refrigerant having been compressed by the second compressor (22) is cooled in the intercooler (29), and then is sucked into the third compressor (23). The refrigerant having been compressed to a pressure equal to or greater than the critical pressure by the third compressor (23) dissipates heat in the outdoor heat exchanger (24), and then passes through the first outdoor expansion valve (26). The first outdoor expansion valve (26) decompresses the refrigerant to a pressure lower than the critical pressure.

The refrigerant in a subcritical state flows into the receiver (25). The receiver (25) separates the refrigerant into a gas refrigerant and a liquid refrigerant.

The liquid refrigerant separated by the receiver (25) is cooled in the subcooling heat exchanger (28) by the refrigerant flowing through the injection flow path (43). The refrigerant in the injection flow path (43) is sent to the intermediate flow path (18).

The refrigerant having been cooled by the subcooling heat exchanger (28) is sent to the air-conditioning unit (60). The refrigerant sent to the air-conditioning unit (60) is decompressed by the indoor expansion valve (63), and then evaporates in the indoor heat exchanger (64). As a result, the indoor air is cooled. The refrigerant having evaporated in the indoor heat exchanger (64) is sucked into and compressed again by the second compressor (22).

(8-3) Cooling and Refrigeration-Facility Operation

Figure 6:
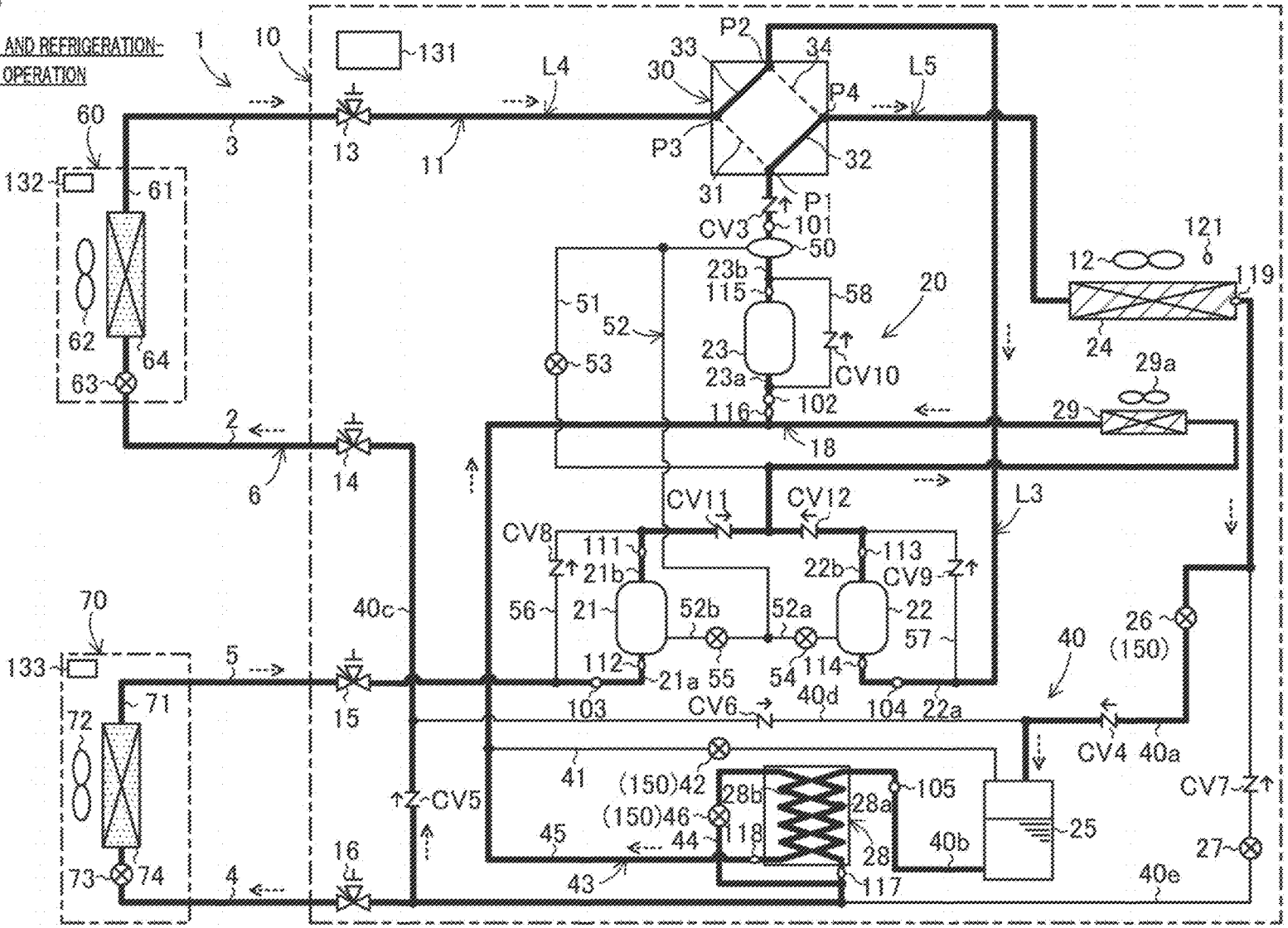
FIG. 6 is a piping system diagram of the refrigeration apparatus and shows the flow of a refrigerant in the cooling and refrigeration-facility operation (the defrosting operation).

In the cooling and refrigeration-facility operation shown in FIG. 6, the control system (130) closes the first on-off valve (V1) and the fourth on-off valve (V4), and opens the second on-off valve (V2) and the third on-off valve (V3). The control system (130) operates the first compressor (21), the second compressor (22), and the third compressor (23). The control system (130) adjusts the opening degrees of the first outdoor expansion valve (26), the injection valve (46), and the venting valve (42), and closes the second outdoor expansion valve (27). The control system (130) adjusts the opening degrees of the refrigeration-facility expansion valve (73) and the indoor expansion valve (63). The control system (130) operates the outdoor fan (12), the indoor fan (62), and the refrigeration-facility fan (72).

In the cooling and refrigeration-facility operation, the refrigeration cycle is performed in which the outdoor heat exchanger (24) functions as a radiator, and the indoor heat exchanger (64) and the refrigeration-facility heat exchanger (74) function as evaporators.

Specifically, the refrigerant having been compressed by the first compressor (21) and the second compressor (22) is cooled by the intercooler (29), and then is sucked into the third compressor (23). The refrigerant having been compressed to a pressure equal to or greater than the critical pressure by the third compressor (23) dissipates heat in the outdoor heat exchanger (24), and then passes through the first outdoor expansion valve (26). The first outdoor expansion valve (26) decompresses the refrigerant to a pressure lower than the critical pressure.

The refrigerant in a subcritical state flows into the receiver (25). The receiver (25) separates the refrigerant into a gas refrigerant and a liquid refrigerant.

The liquid refrigerant separated by the receiver (25) is cooled in the subcooling heat exchanger (28) by the refrigerant flowing through the injection flow path (43). The refrigerant in the injection flow path (43) is sent to the intermediate flow path (18).

The refrigerant having been cooled by the subcooling heat exchanger (28) is sent to the air-conditioning unit (60) and the refrigeration-facility unit (70). The refrigerant sent to the air-conditioning unit (60) is decompressed by the indoor expansion valve (63), and then evaporates in the indoor heat exchanger (64). As a result, the indoor air is cooled. The refrigerant having evaporated in the indoor heat exchanger (64) is sucked into and compressed again by the first compressor (21).

The refrigerant sent to the refrigeration-facility unit (70) is decompressed by the refrigeration-facility expansion valve (73), and then evaporates in the refrigeration-facility heat exchanger (74). As a result, the inside air is cooled. The refrigerant having evaporated in the refrigeration-facility heat exchanger (74) is sucked into and compressed again by the second compressor (22).

(8-4) Heating Operation

Figure 7:
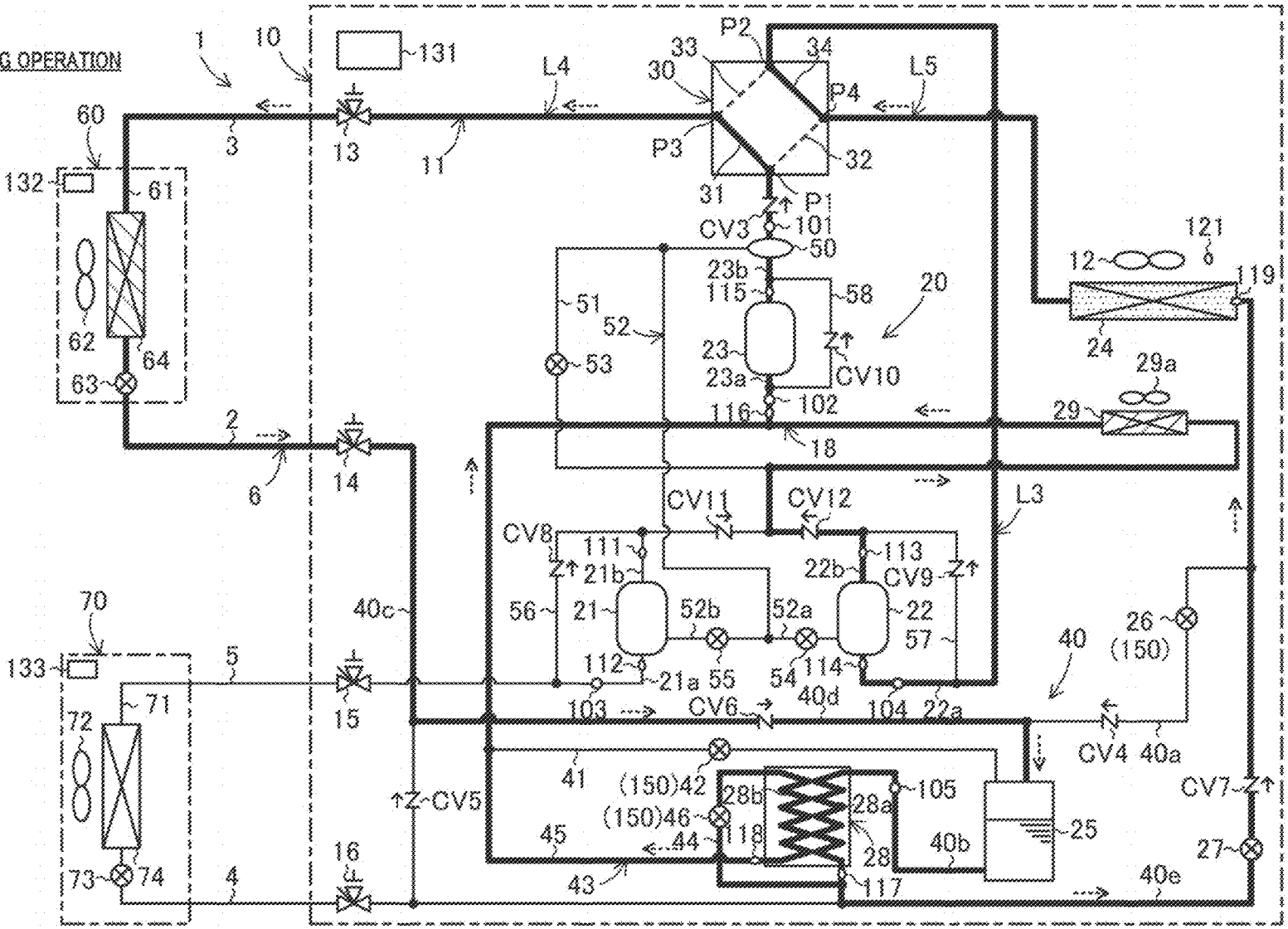
FIG. 7 is a piping system diagram of the refrigeration apparatus and shows the flow of a refrigerant in the heating operation.

In the heating operation shown in FIG. 7, the control system (130) closes the second on-off valve (V2) and the third on-off valve (V3), and opens the first on-off valve (V1) and the fourth on-off valve (V4). The control system (130) stops the first compressor (21), and operates the second compressor (22) and the third compressor (23). The control system (130) adjusts the opening degrees of the second outdoor expansion valve (27), the injection valve (46), and the venting valve (42), and closes the first outdoor expansion valve (26). The control system (130) closes the refrigeration-facility expansion valve (73), and adjusts the opening degree of the indoor expansion valve (63). The control system (130) operates the outdoor fan (12) and the indoor fan (62), and stops the refrigeration-facility fan (72).

In the heating operation, the refrigeration cycle is performed in which the indoor heat exchanger (64) functions as a radiator, the outdoor heat exchanger (24) functions as an evaporator, and the function of the refrigeration-facility heat exchanger (74) is substantially deactivated.

Specifically, the refrigerant having been compressed by the second compressor (22) is cooled in the intercooler (29), and then is sucked into the third compressor (23). The refrigerant having been compressed by the third compressor (23) is sent to the air-conditioning unit (60).

The refrigerant having been sent to the air-conditioning unit (60) dissipates heat in the indoor heat exchanger (64). As a result, the indoor air is heated. The refrigerant having dissipated heat in the indoor heat exchanger (64) flows into the receiver (25). The receiver (25) separates the refrigerant into a gas refrigerant and a liquid refrigerant.

The liquid refrigerant separated by the receiver (25) is cooled in the subcooling heat exchanger (28) by the refrigerant flowing through the injection flow path (43). The refrigerant in the injection flow path (43) is sent to the intermediate flow path (18).

The refrigerant having been cooled by the subcooling heat exchanger (28) is decompressed by the second outdoor expansion valve (27), and then evaporates in the outdoor heat exchanger (24). The refrigerant having evaporated in the outdoor heat exchanger (24) is sucked into and compressed again by the second compressor (22).

(8-5) First Heating and Refrigeration-Facility Operation

Figure 8:
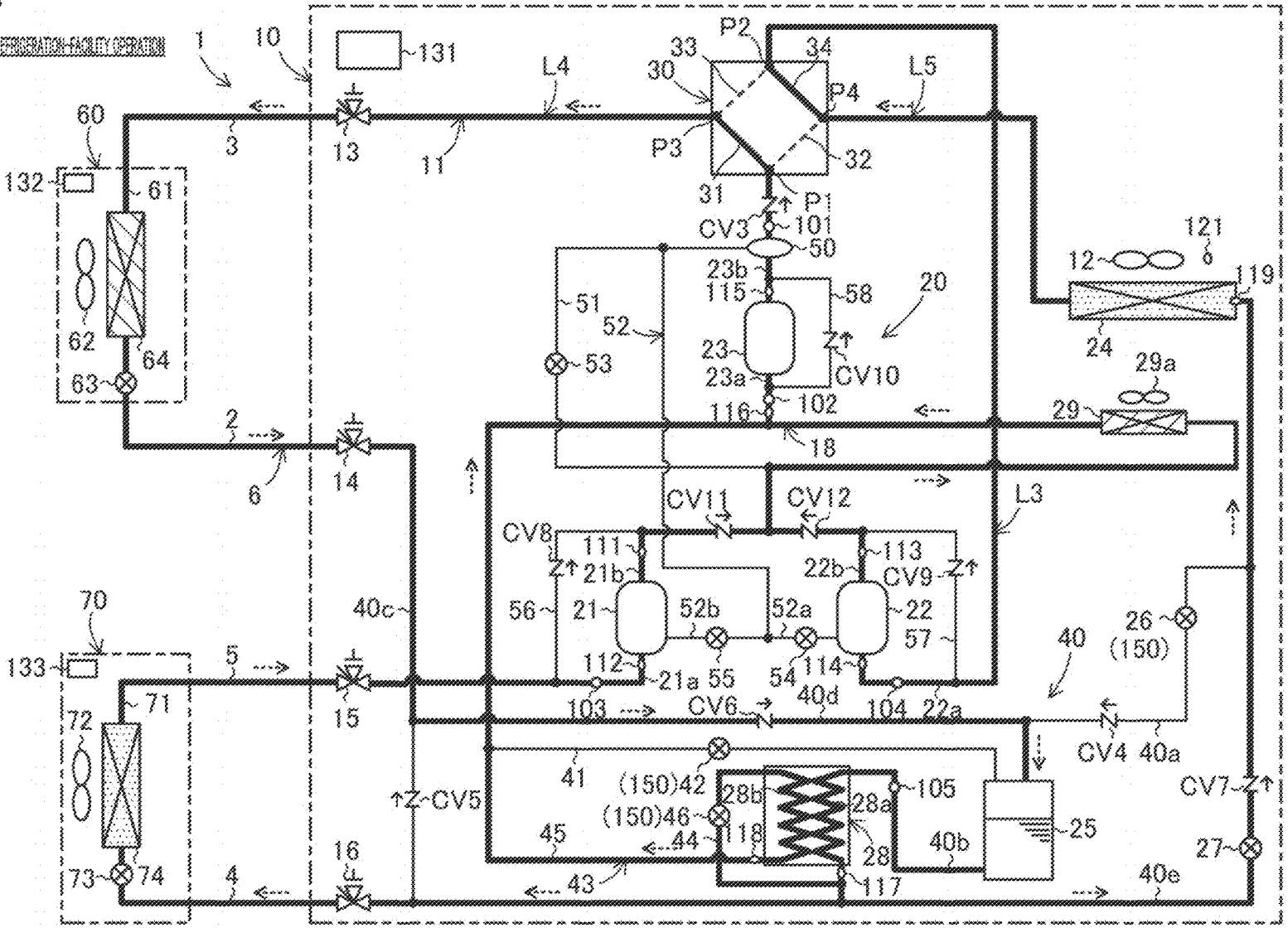
FIG. 8 is a piping system diagram of the refrigeration apparatus and shows the flow of a refrigerant in the first heating and refrigeration-facility operation.

The first heating and refrigeration-facility operation shown in FIG. 8 is executed when the heating load of the air-conditioning unit (60) is high. In the first heating and refrigeration-facility operation, the control system (130) closes the second on-off valve (V2) and the third on-off valve (V3), and opens the first on-off valve (V1) and the fourth on-off valve (V4). The control system (130) operates the first compressor (21), the second compressor (22), and the third compressor (23). The control system (130) adjusts the opening degrees of the second outdoor expansion valve (27), the injection valve (46), and the venting valve (42), and closes the first outdoor expansion valve (26). The control system (130) adjusts the opening degrees of the indoor expansion valve (63) and the refrigeration-facility expansion valve (73). The control system (130) operates the outdoor fan (12), the indoor fan (62), and the refrigeration-facility fan (72).

In the first heating and refrigeration-facility operation, the refrigeration cycle is performed in which the indoor heat exchanger (64) functions as a radiator, and the outdoor heat exchanger (24) and the refrigeration-facility heat exchanger (74) function as evaporators.

Specifically, the refrigerant having been compressed by the first compressor (21) and the second compressor (22) is cooled by the intercooler (29), and then is sucked into the third compressor (23). The refrigerant having been compressed by the third compressor (23) is sent to the air-conditioning unit (60).

The refrigerant having been sent to the air-conditioning unit (60) dissipates heat in the indoor heat exchanger (64). As a result, the indoor air is heated. The refrigerant having dissipated heat in the indoor heat exchanger (64) flows into the receiver (25). The receiver (25) separates the refrigerant into a gas refrigerant and a liquid refrigerant.

The liquid refrigerant separated by the receiver (25) is cooled in the subcooling heat exchanger (28) by the refrigerant flowing through the injection flow path (43). The refrigerant in the injection flow path (43) is sent to the intermediate flow path (18).

A part of the refrigerant having been cooled by the subcooling heat exchanger (28) is decompressed by the second outdoor expansion valve (27), and then evaporates in the outdoor heat exchanger (24). The refrigerant having evaporated in the outdoor heat exchanger (24) is sucked into and compressed again by the first compressor (21).

The rest of the refrigerant having been cooled by the subcooling heat exchanger (28) is sent to the refrigeration-facility unit (70). The refrigerant sent to the refrigeration-facility unit (70) is decompressed by the refrigeration-facility expansion valve (73), and then evaporates in the refrigeration-facility heat exchanger (74). As a result, the inside air is cooled. The refrigerant having evaporated in the refrigeration-facility heat exchanger (74) is sucked into and compressed again by the second compressor (22).

(8-6) Second Heating and Refrigeration-Facility Operation

Figure 9:
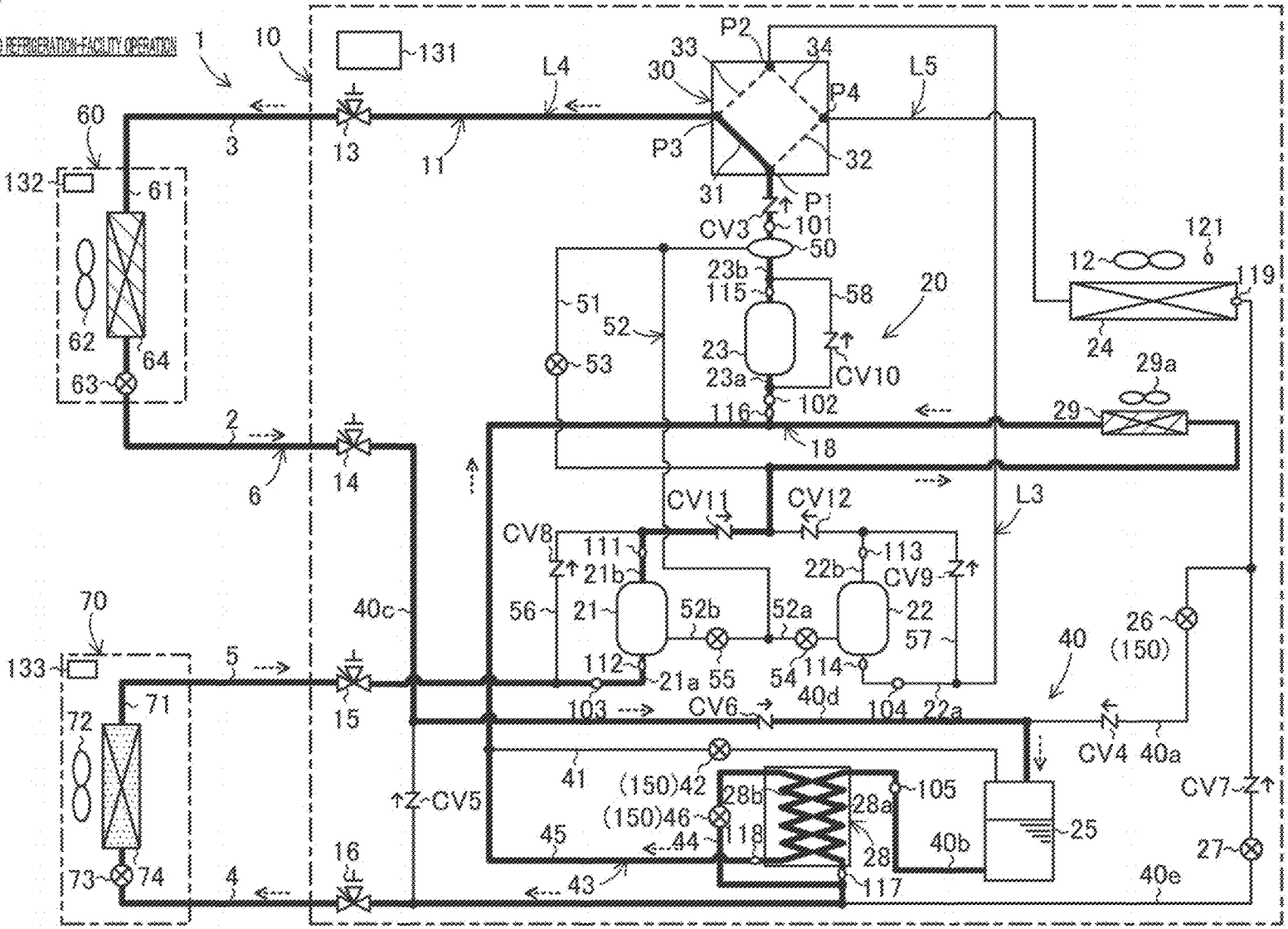
FIG. 9 is a piping system diagram of the refrigeration apparatus and shows the flow of a refrigerant in the second heating and refrigeration-facility operation.

The second heating and refrigeration-facility operation shown in FIG. 9 is executed when the heating load of the air-conditioning unit (60) is neither excessively high nor low. In the second heating and refrigeration-facility operation, the control system (130) closes the second on-off valve (V2), the third on-off valve (V3), and the fourth on-off valve (V4), and opens the first on-off valve (V1). The control system (130) operates the first compressor (21) and the third compressor (23), and stops the second compressor (22). The control system (130) adjusts the opening degrees of the injection valve (46) and the venting valve (42), and closes the first outdoor expansion valve (26) and the second outdoor expansion valve (27). The control system (130) adjusts the opening degrees of the indoor expansion valve (63) and the refrigeration-facility expansion valve (73). The control system (130) stops the outdoor fan (12), and operates the indoor fan (62) and the refrigeration-facility fan (72).

In the second heating and refrigeration-facility operation, the refrigeration cycle is performed in which the indoor heat exchanger (64) functions as a radiator, the outdoor heat exchanger (24) is substantially stopped, and the refrigeration-facility heat exchanger (74) functions as an evaporator.

Specifically, the refrigerant having been compressed by the first compressor (21) is cooled in the intercooler (29), and then is sucked into the third compressor (23). The refrigerant having been compressed by the third compressor (23) is sent to the air-conditioning unit (60).

The refrigerant having been sent to the air-conditioning unit (60) dissipates heat in the indoor heat exchanger (64). As a result, the indoor air is heated. The refrigerant having dissipated heat in the indoor heat exchanger (64) flows into the receiver (25). The receiver (25) separates the refrigerant into a gas refrigerant and a liquid refrigerant.

The liquid refrigerant separated by the receiver (25) is cooled in the subcooling heat exchanger (28) by the refrigerant flowing through the injection flow path (43). The refrigerant in the injection flow path (43) is sent to the intermediate flow path (18).

The refrigerant having been cooled by the subcooling heat exchanger (28) is decompressed by the refrigeration-facility expansion valve (73), and then evaporates in the refrigeration-facility heat exchanger (74). As a result, the inside air is cooled. The refrigerant having evaporated in the refrigeration-facility heat exchanger (74) is sucked into and compressed again by the first compressor (21).

(8-7) Third Heating and Refrigeration-Facility Operation

Figure 10:
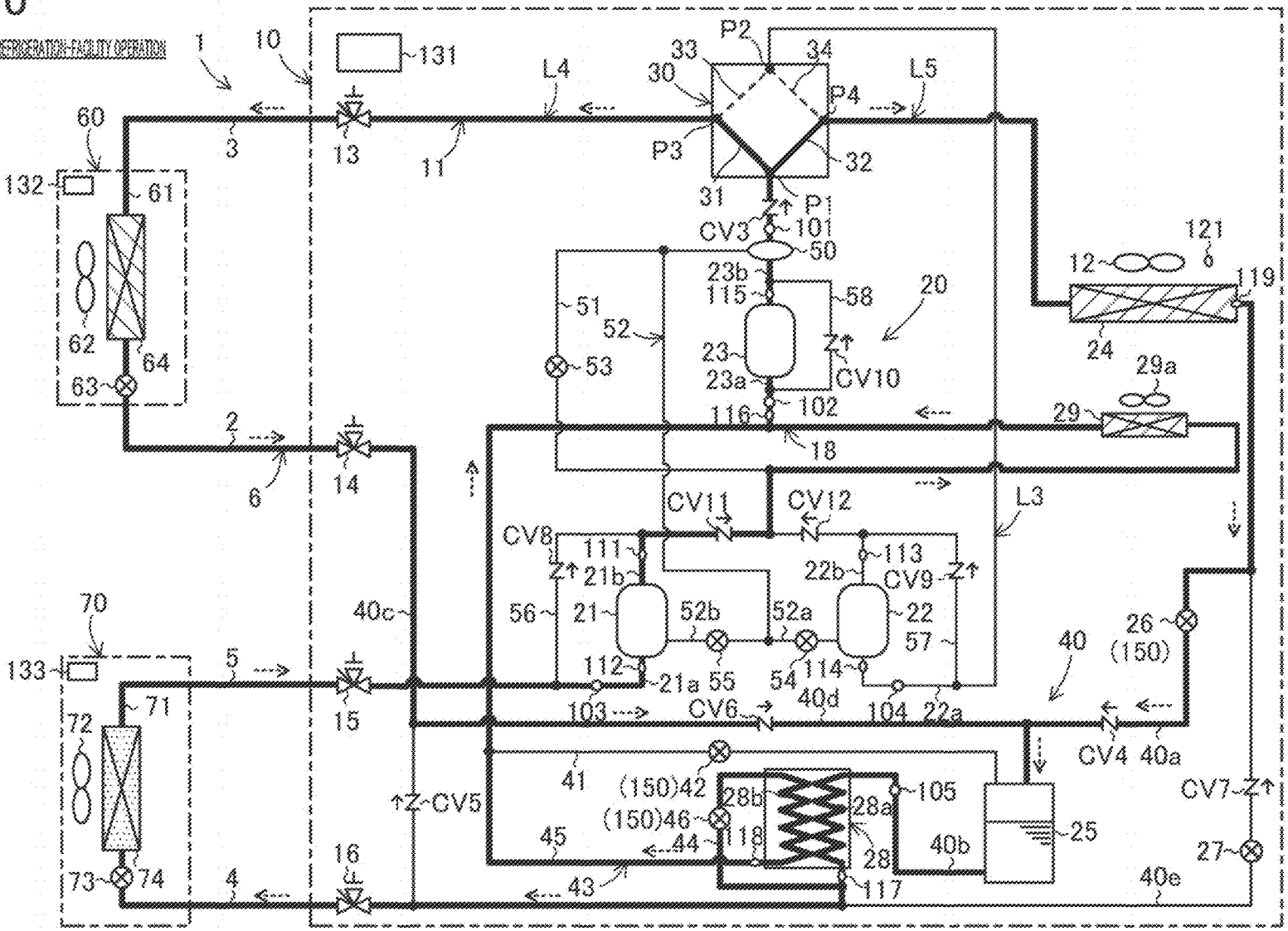
FIG. 10 is a piping system diagram of the refrigeration apparatus and shows the flow of a refrigerant in the third heating and refrigeration-facility operation.

The third heating and refrigeration-facility operation shown in FIG. 10 is executed when the heating load of the air-conditioning unit (60) is low. In the second heating and refrigeration-facility operation, the control system (130) closes the third on-off valve (V3) and the fourth on-off valve (V4), and opens the first on-off valve (V1) and the second on-off valve (V2). The control system (130) operates the first compressor (21) and the third compressor (23), and stops the second compressor (22). The control system (130) adjusts the opening degrees of the first outdoor expansion valve (26), the injection valve (46), and the venting valve (42), and closes the second outdoor expansion valve (27). The control system (130) adjusts the opening degrees of the indoor expansion valve (63) and the refrigeration-facility expansion valve (73). The control system (130) operates the outdoor fan (12), the indoor fan (62), and the refrigeration-facility fan (72).

In the third heating and refrigeration-facility operation, the refrigeration cycle is performed in which the indoor heat exchanger (64) and the outdoor heat exchanger (24) function as radiators, and the refrigeration-facility heat exchanger (74) functions as an evaporator.

Specifically, the refrigerant having been compressed by the first compressor (21) is cooled in the intercooler (29), and then is sucked into the third compressor (23). A part of the refrigerant having been compressed by the third compressor (23) is sent to the air-conditioning unit (60). The refrigerant having been sent to the air-conditioning unit (60) dissipates heat in the indoor heat exchanger (64). As a result, the indoor air is heated. The refrigerant having dissipated heat in the indoor heat exchanger (64) flows into the receiver (25). The rest of the refrigerant having been compressed by the third compressor (23) dissipates heat in the outdoor heat exchanger (24), and then flows into the receiver (25). The receiver (25) separates the refrigerant into a gas refrigerant and a liquid refrigerant.

The liquid refrigerant separated by the receiver (25) is cooled in the subcooling heat exchanger (28) by the refrigerant flowing through the injection flow path (43). The refrigerant in the injection flow path (43) is sent to the intermediate flow path (18).

The refrigerant having been cooled by the subcooling heat exchanger (28) is decompressed by the refrigeration-facility expansion valve (73), and then evaporates in the refrigeration-facility heat exchanger (74). As a result, the inside air is cooled. The refrigerant having evaporated in the refrigeration-facility heat exchanger (74) is sucked into and compressed again by the first compressor (21).

(8-8) Defrosting Operation

The defrosting operation is executed to melt the frost on the outdoor heat exchanger (24) in winter or the like. For example, during the heating and refrigeration-facility operation, the control system (130) executes the defrosting operation if the condition for the outdoor heat exchanger (24) being frosted is true. The basic operation of the defrosting operation is the same as the cooling operation shown in FIG. 5 and the cooling and refrigeration-facility operation shown in FIG. 6. In the outdoor heat exchanger (24), the high-pressure refrigerant dissipates heat to the outside, thereby melting the frost on the surface of the outdoor heat exchanger (24).

(9) Control Operation of Outdoor Controller

In the refrigeration apparatus (1) of this embodiment, the outdoor controller (131) of the control system (130) performs protection operation and performs control of the first outdoor expansion valve (26).

(9-1) Protection Operation

The protection operation by the outdoor controller (131) will be described below. The pressure values given in this description are mere examples.

When the refrigeration apparatus (1) is operating, the outdoor controller (131) monitors a measurement value of the high pressure sensor (101). The measurement value PH of the high pressure sensor (101) is a high pressure of the refrigeration cycle.

If the measurement value PH of the high pressure sensor (101) is higher than a predetermined upper limit pressure (e.g., 11 MPa), the outdoor controller (131) performs the protection operation in order to forcibly reduce the operation capacity of the compression unit (20). The upper limit pressure is lower than a design pressure of the heat source unit (e.g., 12 MPa).

Specifically, the outdoor controller (131) reduces the rotational speed of a compressor in operation among the first compressor (21), the second compressor (22), and the third compressor (23) constituting the compression unit (20) by a predetermined value at the time when it is determined that the measurement value PH of the high pressure sensor (101) is higher than the upper limit pressure. As a result, the operating capacity of the compression unit (20) is reduced. If the operating capacity of the compression unit (20) decreases, the flow rate of the refrigerant discharged from the compression unit (20) decreases, and the high pressure of the refrigeration cycle decreases.

(9-2) Control of First Outdoor Expansion Valve

In the cooling operation, the refrigeration-facility operation, and the cooling and refrigeration-facility operation, the outdoor controller (131) controls the first outdoor expansion valve (26).

In the cooling operation, the refrigeration-facility operation, and the cooling and refrigeration-facility operation, the outdoor heat exchanger (24) functions as a radiator. If the opening degree of the first outdoor expansion valve (26) is changed in a state in which the outdoor heat exchanger (24) functions as a radiator, the pressure of the refrigerant in the outdoor heat exchanger (24) changes. The pressure of a refrigerant in the outdoor heat exchanger (24) is a high pressure of the refrigeration cycle. Thus, the first outdoor expansion valve (26) is a refrigerant control valve (150) where if its opening degree is changed, the high pressure of the refrigeration cycle changes.

The outdoor controller (131) increases or decreases the opening degree of the first outdoor expansion valve (26) in a stepwise manner. The amount of change by one step in the opening degree of the first outdoor expansion valve (26) employed when the outdoor controller (131) controls the first outdoor expansion valve (26) is the unit change amount ΔEV1. The unit change amount ΔEV1 employed when the opening degree of the first outdoor expansion valve (26) is increased is the unit increase amount, and the unit change amount ΔEV1 employed when the opening degree of the first outdoor expansion valve (26) is decreased is the unit decrease amount. In the outdoor controller (131) of this embodiment, the unit increase amount and the unit decrease amount of the opening degree of the first outdoor expansion valve (26) are the same value.

The outdoor controller (131) adjusts the opening degree of the first outdoor expansion valve (26) based on the pressure of the refrigerant in the receiver (25) (hereinafter referred to as the receiver pressure Pr). The outdoor controller (131) changes the unit change amount ΔEV1 of the opening degree of the first outdoor expansion valve (26) based on the temperature of outdoor air (the outdoor air temperature To).

The outdoor air temperature To is a measurement value of the outdoor air temperature sensor (121). Here, if, in the operation in which the outdoor heat exchanger (24) functions as a radiator, the operation capacity of the compression unit (20) is the same, the cooling capacity of the refrigeration apparatus (1) decreases as the outdoor air temperature To increases. In order to less decrease the cooling capacity, the refrigeration apparatus (1) increases the high pressure of the refrigeration cycle by increasing the operating capacity of the compression unit (20). In this manner, as the outdoor air temperature To increases, the high pressure of the refrigeration cycle increases. Thus, the outdoor air temperature To is a physical quantity indicating the high pressure of the refrigeration cycle (i.e., the high pressure index).

Figure 11:
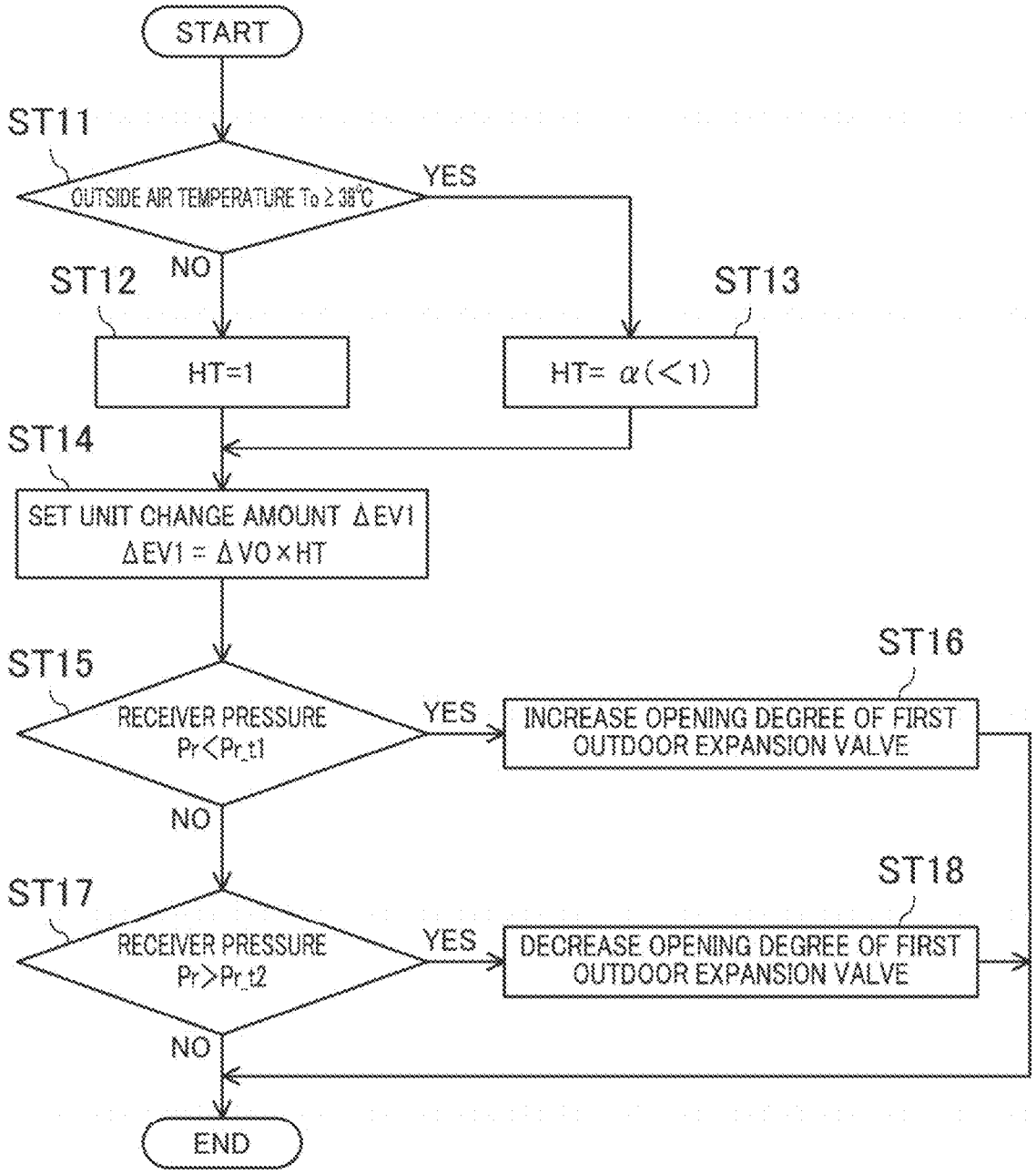
FIG. 11 is a flowchart of the control of the first outdoor expansion valve by the outdoor controller of the first embodiment.

The operation of the outdoor controller (131) controlling the first outdoor expansion valve (26) will be described with reference to the flowchart of FIG. 11. The outdoor controller (131) repeats the operation shown in FIG. 11 every predetermined time (e.g., every 10 seconds). Note that the specific numerical values shown in this description are mere examples.

In the process of step ST11, the outdoor controller (131) obtains the measurement value of the outdoor air temperature sensor (121) as the outdoor air temperature To. The outdoor controller (131) compares the obtained outdoor air temperature To with a predetermined reference value (38° C. in this embodiment). Specifically, the outdoor controller (131) determines whether the condition that the outdoor air temperature To is 38° C. or higher is true.

The reference value (38° C. in this embodiment) of the outdoor air temperature To is set to a value higher than the temperature of the critical point (the critical temperature) of a refrigerant in the refrigerant circuit (6) (carbon dioxide in this embodiment).

If the outdoor air temperature To is lower than 38° C., the outdoor controller (131) conducts the process of step ST12 to employ HT=1. If the outdoor air temperature To is 38° C. or higher, the outdoor controller (131) conducts the process of step ST13 to employ HT=α. HT is a coefficient used to determine the unit change amount ΔEV1. α is a numerical value higher than 0 and lower than 1. In this embodiment, α=0.5 is employed.

If the process of step ST12 or step ST13 is completed, the outdoor controller (131) conducts the process of step ST14. In this process, the outdoor controller (131) sets the unit change amount ΔEV1 of the first outdoor expansion valve (26).

Specifically, the outdoor controller (131) sets the unit change amount ΔEV1 to ΔVO×HT (ΔEV1=ΔVO×HT). ΔVO is a reference change amount of the opening degree of the electronic expansion valve. In this embodiment, ΔVO is 100 pulses. Thus, the outdoor controller (131) of this embodiment sets the unit change amount ΔEV1 to 100 pulses if the outdoor air temperature To<38° C., and sets the unit change amount ΔEV1 to 50 pulses if the outdoor air temperature To≥38° C.

Next, in the process of step ST15, the outdoor controller (131) obtains the measurement value of the liquid-side pressure sensor (105) as the receiver pressure Pr. The outdoor controller (131) compares the obtained receiver pressure Pr with the lower limit value Pr_t1 of the target range. The outdoor controller (131) conducts the process of step ST16 if the condition that the receiver pressure Pr is lower than the lower limit value Pr_t1 (Pr<Pr_t1) is true, and conducts the process of step ST17 if the condition is not true.

In the process of step ST16, the outdoor controller (131) increases the opening degree of the first outdoor expansion valve (26) by the unit change amount ΔEV1 set in the process of step ST14. If the opening degree of the first outdoor expansion valve (26) increases in a state in which the outdoor heat exchanger (24) functions as a radiator, the pressure of a refrigerant flowing into the receiver (25) increases, and the receiver pressure Pr increases. If the opening degree of the first outdoor expansion valve (26) increases in this state, the pressure of the refrigerant in the outdoor heat exchanger (24) functioning as a radiator decreases, and the high pressure of the refrigeration cycle decreases.

In the process of step ST17, the outdoor controller (131) compares the obtained receiver pressure Pr with the upper limit value Pr_t2 of the target range. The upper limit value Pr_t2 of the target range is a value lower than the critical pressure of the refrigerant. If the condition that the receiver pressure Pr is higher than the upper limit value Pr_t2 (Pr>Pr_t2) is true, the outdoor controller (131) conducts the process of step ST18.

In the process of step ST18, the outdoor controller (131) decreases the opening degree of the first outdoor expansion valve (26) by the unit change amount ΔEV1 set in the process of step ST14. If the opening degree of the first outdoor expansion valve (26) decreases in a state in which the outdoor heat exchanger (24) functions as a radiator, the pressure of the refrigerant flowing into the receiver (25) decreases, and the receiver pressure Pr decreases. If the opening degree of the first outdoor expansion valve (26) decreases in this state, the pressure of the refrigerant in the outdoor heat exchanger (24) functioning as a radiator increases, and the high pressure of the refrigeration cycle increases.

If the condition in the process of step ST17 is not true, the receiver pressure Pr is in the target range. Thus, if this condition is not true, the outdoor controller (131) does not change the opening degree of the first outdoor expansion valve (26), and ends the control operation of the first outdoor expansion valve (26).

(10) Features of First Embodiment

The outdoor controller (131) of this embodiment changes "the unit change amount ΔEV1 employed when the outdoor air temperature To as the high pressure index is higher than the reference value" to a value lower than "the unit change amount ΔEV1 employed when the high pressure index is lower than the reference value." Thus, according to this embodiment, the upper limit value of the high pressure of the refrigeration cycle (the upper limit pressure) can be more increased than according to conventional ways, and the cooling capacity of the refrigeration apparatus (1) obtained in a state in which the high pressure of the refrigeration cycle is higher than the critical pressure of the refrigerant can be increased.

This point will be described below. Note that the specific numerical values shown below are mere examples.

In the heat source unit (10) of the refrigeration apparatus (1), the high-pressure of the refrigeration cycle is absolutely required not to exceed the design pressure (e.g., 12 MPa) of the heat source unit (10). This is because the heat source unit (10) is damaged if the high pressure of the refrigeration cycle is higher than the design pressure of the heat source unit (10). Thus, if the high pressure of the refrigeration cycle is higher than a predetermined upper limit pressure when the operation is being performed, the heat source unit (10) performs the protection operation to avoid damage to the heat source unit (10).

When the heat source unit (10) performs the protection operation, the refrigeration capacity of the refrigeration apparatus (1) decreases. Thus, from the viewpoint of ensuring the cooling capacity of the refrigeration apparatus (1), the difference between the design pressure and the upper limit pressure is desirably as small as possible. However, if the difference between the design pressure and the upper limit pressure is too small, and the opening degree of the first outdoor expansion valve (26) is changed by one step in a state in which the high pressure of the refrigeration cycle is slightly lower than the upper limit pressure, the high pressure of the refrigeration cycle might increase and the high pressure of the refrigeration cycle might exceed the design pressure. Thus, in conventional ways, the upper limit pressure is necessarily set to a somewhat lower value (e.g., 10 MPa) than the design pressure (e.g., 12 MPa).

As a solution to this problem, it is conceivable that the unit change amount of the opening degree of the first outdoor expansion valve (26) is set to a relatively small value (e.g., 50 pulses) in any cases. However, if the unit change amount of the opening degree of the first outdoor expansion valve (26) is set to a small value, the opening degree of the first outdoor expansion valve (26) cannot be changed in accordance with the change in the operation state of the refrigeration apparatus (1), and thus the opening degree of the first outdoor expansion valve (26) might be unable to be controlled appropriately.

Thus, the outdoor controller (131) of this embodiment changes "the unit change amount ΔEV1 employed when the high pressure index is higher than the reference value" to a value lower than "the unit change amount ΔEV1 employed when the high pressure index is lower than the reference value."

It can be estimated that in a state in which the outdoor air temperature To as the high pressure index is higher than the reference value, the high pressure of the refrigeration cycle is a value close to the upper limit pressure. Thus, in this state, the outdoor controller (131) changes "the unit change amount ΔEV1 employed when the outdoor air temperature To as the high pressure index is higher than the reference value" to a value lower than "the unit change amount ΔEV1 employed when the outdoor air temperature To is lower than the reference value." As a result, as compared with the case in which "the unit change amount employed when the outdoor air temperature To is higher than the reference value" is equal to "the unit change amount employed when the outdoor air temperature To is lower than the reference value," the amount of change in the high pressure of the refrigeration cycle that is obtained when the opening degree of the first outdoor expansion valve (26) is changed by one step in a state in which the outdoor air temperature To is higher than the reference value is smaller.

In this manner, according to this embodiment, the amount of change in the high pressure of the refrigeration cycle that is obtained when the opening degree of the first outdoor expansion valve (26) is changed by one step in a state in which the outdoor air temperature To as the high pressure index is higher than the reference value can be smaller. Thus, the upper limit pressure as a reference value at which the heat source unit (10) starts the protection operation can be set to a value closer to the design pressure of the heat source unit (10) (e.g., 11 MPa) than according to conventional ways. Thus, according to this embodiment, the high pressure of the refrigeration cycle obtained when the outdoor air temperature To is higher than the reference value can be set to a higher value than according to conventional ways, and the cooling capacity of the refrigeration apparatus (1) can be increased.

Further, according to the outdoor controller (131) of this embodiment, the unit change amount ΔEV1 employed when the outdoor air temperature To as the high pressure index is lower than the reference value can be set to the same value as according to conventional ways. Thus, according to this embodiment, similarly to conventional ways, in a state in which the outdoor air temperature To is lower than the reference value, the opening degree of the first outdoor expansion valve (26) can be changed in accordance with the change in the operation state of the refrigeration apparatus (1), and the opening degree of the first outdoor expansion valve (26) can be controlled appropriately.

(11) Variations of First Embodiment

The outdoor controller (131) of this embodiment may be configured to change only the unit decrease amount among the unit increase amount and the unit decrease amount of the opening degree of the first outdoor expansion valve (26) based on the outdoor air temperature To as the high pressure index.

If the opening degree of the first outdoor expansion valve (26) decreases in a state in which the outdoor heat exchanger (24) functions as a radiator, the high pressure of the refrigeration cycle increases. Thus, the outdoor controller (131) of this variation changes "the unit decrease amount of the first outdoor expansion valve (26) employed when the outdoor air temperature To as the high pressure index is higher than the reference value" to a value smaller than "the unit decrease amount of the first outdoor expansion valve (26) employed when the high pressure index is lower than the reference value." In contrast, the outdoor controller (131) of this variation keeps the unit increase amount of the first outdoor expansion valve (26) constant regardless of the outdoor air temperature To as the high pressure index.

Second Embodiment

A second embodiment will be described below. The heat source unit (10) of this embodiment includes a modified version of the outdoor controller (131) of the heat source unit (10) of the first embodiment.

The outdoor controller (131) of this embodiment is configured to change the unit change amount ΔEV2 of the opening degree of the injection valve (46) based on the outdoor air temperature To as the high pressure index.

If the opening degree of the injection valve (46) is changed, the flow rate of the refrigerant sent to the third compressor (23) through the injection flow path (43) changes, and as a result, the pressure of the refrigerant discharged from the third compressor (23) (the discharge pressure) changes. The discharge pressure of the third compressor (23) is substantially the high pressure of the refrigeration cycle. Thus, the injection valve (46) is a refrigerant control valve (150) where if its opening degree is changed, the high pressure of the refrigeration cycle changes.

The outdoor controller (131) of this embodiment increases or decreases the opening degree of the injection valve (46) in a stepwise manner. The amount of change by one step in the opening degree of the injection valve (46) employed when the outdoor controller (131) controls the injection valve (46) is the unit change amount ΔEV2. The unit change amount ΔEV2 employed when the opening degree of the injection valve (46) is increased is the unit increase amount, and the unit change amount ΔEV2 employed when the opening degree of the injection valve (46) is decreased is the unit decrease amount. In the outdoor controller (131) of this embodiment, the unit increase amount and the unit decrease amount of the opening degree of the injection valve (46) are the same value.

(1) Control of Injection Valve by Outdoor Controller

The outdoor controller (131) of this embodiment adjusts the opening degree of the injection valve (46) based on the degree of subcooling SC of the refrigerant at the outlet of the first flow path (28*a*) of the subcooling heat exchanger (28) and the degree of superheat of the refrigerant sucked into the third compressor (23) (the degree of suction superheat SH). The outdoor controller (131) changes the unit change amount ΔEV2 of the opening degree of the injection valve (46) based on the temperature of outdoor air (the outdoor air temperature To).

Figure 12:
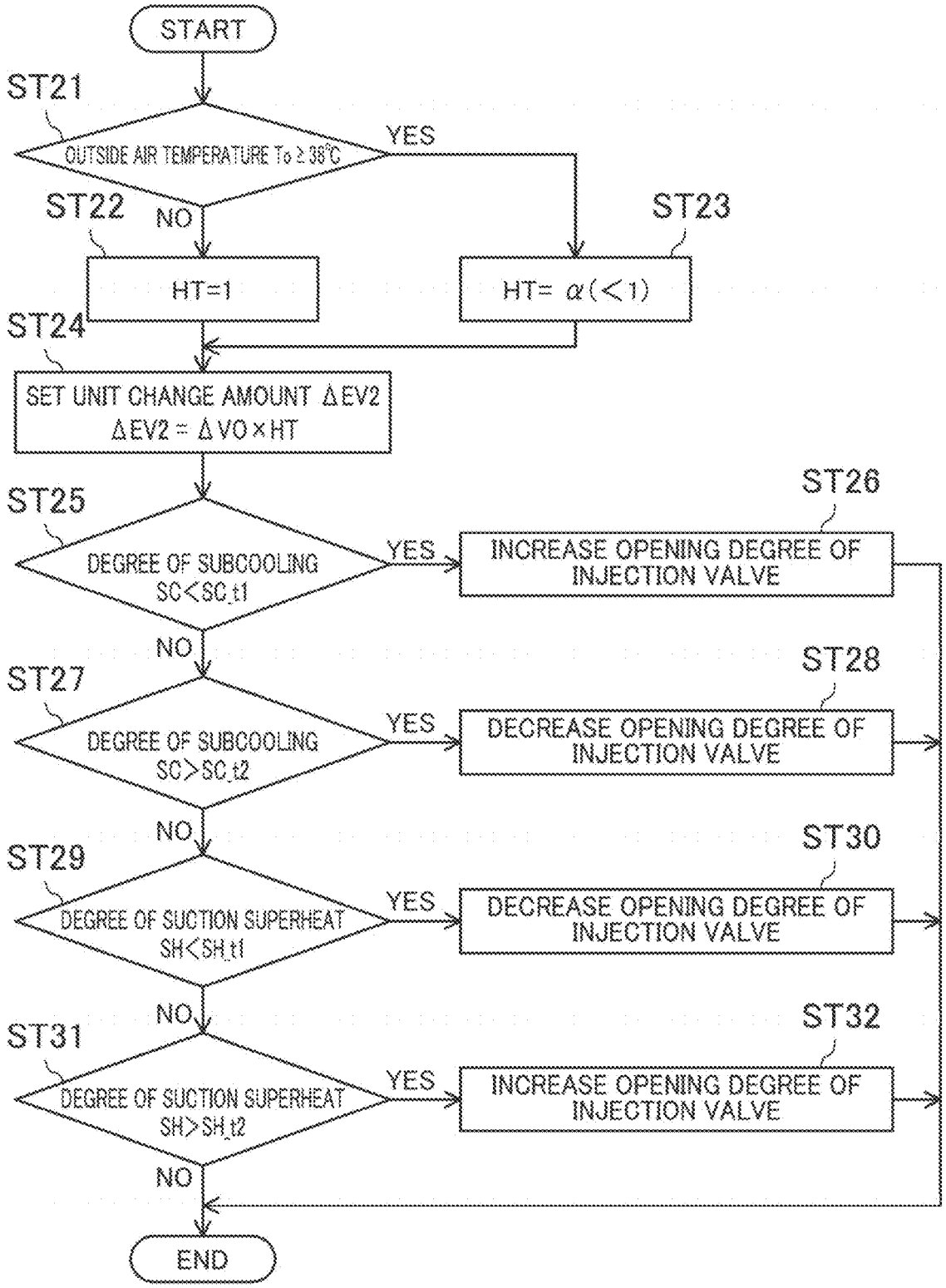
FIG. 12 is a flowchart of the control of the injection valve by the outdoor controller of a second embodiment.

The operation of the outdoor controller (131) of this embodiment controlling the injection valve (46) will be described with reference to the flowchart of FIG. 12. The outdoor controller (131) repeats the operation shown in FIG. 12 every predetermined time (e.g., every seconds). Note that the specific numerical values shown in this description are mere examples.

In the process of step ST21, the outdoor controller (131) obtains the measurement value of the outdoor air temperature sensor (121) as the outdoor air temperature To. The outdoor controller (131) compares the obtained outdoor air temperature To with a predetermined reference value (38° C. in this embodiment). Specifically, the outdoor controller (131) determines whether the condition that the outdoor air temperature To is 38° C. or higher is true.

If the outdoor air temperature To is lower than 38° C., the outdoor controller (131) conducts the process of step ST22 to employ HT=1. If the outdoor air temperature To is 38° C. or higher, the outdoor controller (131) conducts the process of step ST23 to employ HT=a. HT is a coefficient used to determine the unit change amount ΔEV2. α is a numerical value higher than 0 and lower than 1. In this embodiment, α=0.5 is employed.

If the process of step ST22 or step ST23 is completed, the outdoor controller (131) conducts the process of step ST24. In this process, the outdoor controller (131) sets the unit change amount ΔEV2 of the injection valve (46).

Specifically, the outdoor controller (131) sets the unit change amount ΔEV2 to ΔVO×HT (ΔEV2=ΔVO×HT). ΔVO is a reference change amount of the opening degree of the electronic expansion valve. In this embodiment, ΔVO is 100 pulses. Thus, the outdoor controller (131) of this embodiment sets the unit change amount ΔEV2 to 100 pulses if the outdoor air temperature To<38° C., and sets the unit change amount ΔEV2 to 50 pulses if the outdoor air temperature To≥38° C.

Next, in the process of step ST25, the outdoor controller (131) calculates the degree of subcooling SC of the refrigerant at the outlet of the first flow path (28*a*) of the subcooling heat exchanger (28). Specifically, the outdoor controller (131) obtains the measurement value of the liquid-side pressure sensor (105) and the measurement value of the liquid-side temperature sensor (117). Then, the outdoor controller (131) obtains a value by subtracting the measurement value TL of the liquid-side temperature sensor (117) from the saturation temperature TLs of the refrigerant in the measurement value of the liquid-side pressure sensor (105), and then regards this value as the degree of subcooling SC (SC=TLs−TL).

In the process of step ST25, the outdoor controller (131) compares the calculated degree of subcooling SC with the lower limit value SC_t1 (e.g., 2° C.) of the target range. The outdoor controller (131) conducts the process of step ST26 if the condition that the degree of subcooling SC is lower than the lower limit value SC_t1 (SC<SC_t1) is true, and conducts the process of step ST27 if the condition is not true.

In the process of step ST26, the outdoor controller (131) increases the opening degree of the injection valve (46) by the unit change amount ΔEV2 set in the process of step ST24. If the opening degree of the injection valve (46) increases, the flow rate of the refrigerant flowing through the second flow path (28*b*) of the subcooling heat exchanger (28) increases, and the temperature of the refrigerant at the outlet of the first flow path (28*a*) of the subcooling heat exchanger (28) decreases. Thus, the degree of subcooling SC increases. If the opening degree of the injection valve (46) increases, the flow rate of the refrigerant flowing into the third compressor (23) through the injection flow path (43) increases, and the high pressure of the refrigeration cycle increases.

In the process of step ST27, the outdoor controller (131) compares the calculated degree of subcooling SC with the upper limit value SC_t2 (e.g., 4° C.) of the target range. The outdoor controller (131) conducts the process of step ST28 if the condition that the degree of subcooling SC is higher than the upper limit value SC_t2 (SC>SC_t2) is true, and conducts the process of step ST29 if the condition is not true.

In the process of step ST28, the outdoor controller (131) increases the opening degree of the injection valve (46) by the unit change amount ΔEV2 set in the process of step ST24. If the opening degree of the injection valve (46) decreases, the flow rate of the refrigerant flowing through the second flow path (28*b*) of the subcooling heat exchanger (28) decreases, and the temperature of the refrigerant at the outlet of the first flow path (28*a*) of the subcooling heat exchanger (28) increases. Thus, the degree of subcooling SC decreases. If the opening degree of the injection valve (46) decreases, the flow rate of the refrigerant flowing into the third compressor (23) through the injection flow path (43) decreases, and the high pressure of the refrigeration cycle decreases.

In the process of step ST29, the outdoor controller (131) calculates the degree of superheat of the refrigerant sucked into the third compressors (23) (the degree of suction superheat SH). Specifically, the outdoor controller (131) obtains the measurement value of the intermediate pressure sensor (102) and the measurement value of the third suction temperature sensor (116). Then, the outdoor controller (131) obtains a value by subtracting the saturation temperature TGs of the refrigerant in the measurement value of the intermediate pressure sensor (102) from the measurement value TG of the third suction temperature sensor (116), and then regards this value as the degree of suction superheat SH (SH=TG−TGs).

In the process of step ST29, the outdoor controller (131) compares the calculated degree of suction superheat SH with the lower limit value SH_t1 (e.g., 5° C.) of the target range. The outdoor controller (131) conducts the process of step ST30 if the condition that the degree of suction superheat SH is lower than the lower limit value SH_t1 (SH<SH_t1) is true, and conducts the process of step ST31 if the condition is not true.

In the process of step ST30, the outdoor controller (131) decreases the opening degree of the injection valve (46) by the unit change amount ΔEV2 set in the process of step ST24. If the opening degree of the injection valve (46) decreases, the flow rate of the refrigerant flowing into the third compressor (23) through the injection flow path (43)

decreases, and the temperature of the refrigerant sucked into the third compressor (23) increases. Thus, the degree of suction superheat SH increases.

In the process of step ST31, the outdoor controller (131) compares the calculated degree of suction superheat SH with the upper limit value SH_t2 (e.g., 10° C.) of the target range. If the condition that the degree of suction superheat SH is higher than the upper limit value SH_t2 (SH>SH_t2) is true, the outdoor controller (131) conducts the process of step ST32.

In the process of step ST32, the outdoor controller (131) increases the opening degree of the injection valve (46) by the unit change amount ΔEV2 set in the process of step ST24. If the opening degree of the injection valve (46) increases, the flow rate of the refrigerant flowing into the third compressor (23) through the injection flow path (43) increases, and the temperature of the refrigerant sucked into the third compressor (23) decreases. Thus, the degree of suction superheat SH decreases.

If the condition in the process of step ST31 is not true, the degree of subcooling SC and the degree of suction superheat SH are in their target ranges. Thus, if this condition is not true, the outdoor controller (131) does not change the opening degree of the injection valve (46), and ends the control operation of the injection valve (46).

(2) Variations of Second Embodiment

Variations of the second embodiment will be described below.

(2-1) First Variation

The outdoor controller (131) of this embodiment may be configured to change both the unit change amount ΔEV1 of the opening degree of the first outdoor expansion valve (26) and the unit change amount ΔEV2 of the opening degree of the injection valve (46) based on the outdoor air temperature To as the high pressure index. The outdoor controller (131) of this variation adjusts the opening degree of the first outdoor expansion valve (26) in the same way the outdoor controller (131) of the first embodiment does.

(2-2) Second Variation

The outdoor controller (131) of this embodiment may be configured to change only the unit increase amount among the unit increase amount and the unit decrease amount of the opening degree of the injection valve (46) based on the outdoor air temperature To as the high pressure index.

If the opening degree of the injection valve (46) is increased, the flow rate of the refrigerant sent to the third compressor (23) through the injection flow path (43) increases, and as a result, the pressure of the refrigerant discharged from the third compressor (23) (the discharge pressure) increases. Thus, the outdoor controller (131) of this variation changes "the unit increase amount of the injection valve (46) employed when the outdoor air temperature To as the high pressure index is higher than the reference value" to a value smaller than "the unit increase amount of the injection valve (46) employed when the high pressure index is lower than the reference value." In contrast, the outdoor controller (131) of this variation keeps the unit decrease amount of the injection valve (46) constant regardless of the outdoor air temperature To as the high pressure index.

Third Embodiment

A third embodiment will be described below. The heat source unit (10) of this embodiment includes a modified version of the outdoor controller (131) of the heat source unit (10) of the first embodiment.

The outdoor controller (131) of this embodiment is configured to change the unit change amount ΔEV3 of the opening degree of the venting valve (42) based on the outdoor air temperature To as the high pressure index.

If the opening degree of the venting valve (42) is changed, the flow rate of the refrigerant sent to the third compressor (23) through the venting pipe (41) changes. As a result, the state of the refrigerant sucked into the third compressor (23) changes, and the pressure of the refrigerant discharged from the third compressor (23) (the discharge pressure) changes. The discharge pressure of the third compressor (23) is substantially the high pressure of the refrigeration cycle. Thus, the venting pipe (41) is a refrigerant control valve (150) where if its opening degree is changed, the high pressure of the refrigeration cycle changes.

The outdoor controller (131) of this embodiment increases or decreases the opening degree of the venting valve (42) in a stepwise manner. The amount of change by one step in the opening degree of the venting valve (42) employed when the outdoor controller (131) controls the venting valve (42) is the unit change amount ΔEV3. The unit change amount ΔEV3 employed when the opening degree of the venting valve (42) is increased is the unit increase amount, and the unit change amount ΔEV3 employed when the opening degree of the venting valve (42) is decreased is the unit decrease amount. In the outdoor controller (131) of this embodiment, the unit increase amount and the unit decrease amount of the opening degree of the venting valve (42) are the same value.

(1) Control of Venting Valve by Outdoor Controller

The outdoor controller (131) of this embodiment adjusts the opening degree of the venting valve (42) based on the receiver pressure Pr; the degree of superheat of the refrigerant sucked into the third compressor (23) (the degree of suction superheat SH); and the pressure of the refrigerant sucked into the third compressor (23) (the intermediate pressure Pm). The outdoor controller (131) changes the unit change amount ΔEV3 of the opening degree of the venting valve (42) based on the temperature of outdoor air (the outdoor air temperature To).

Figure 13:
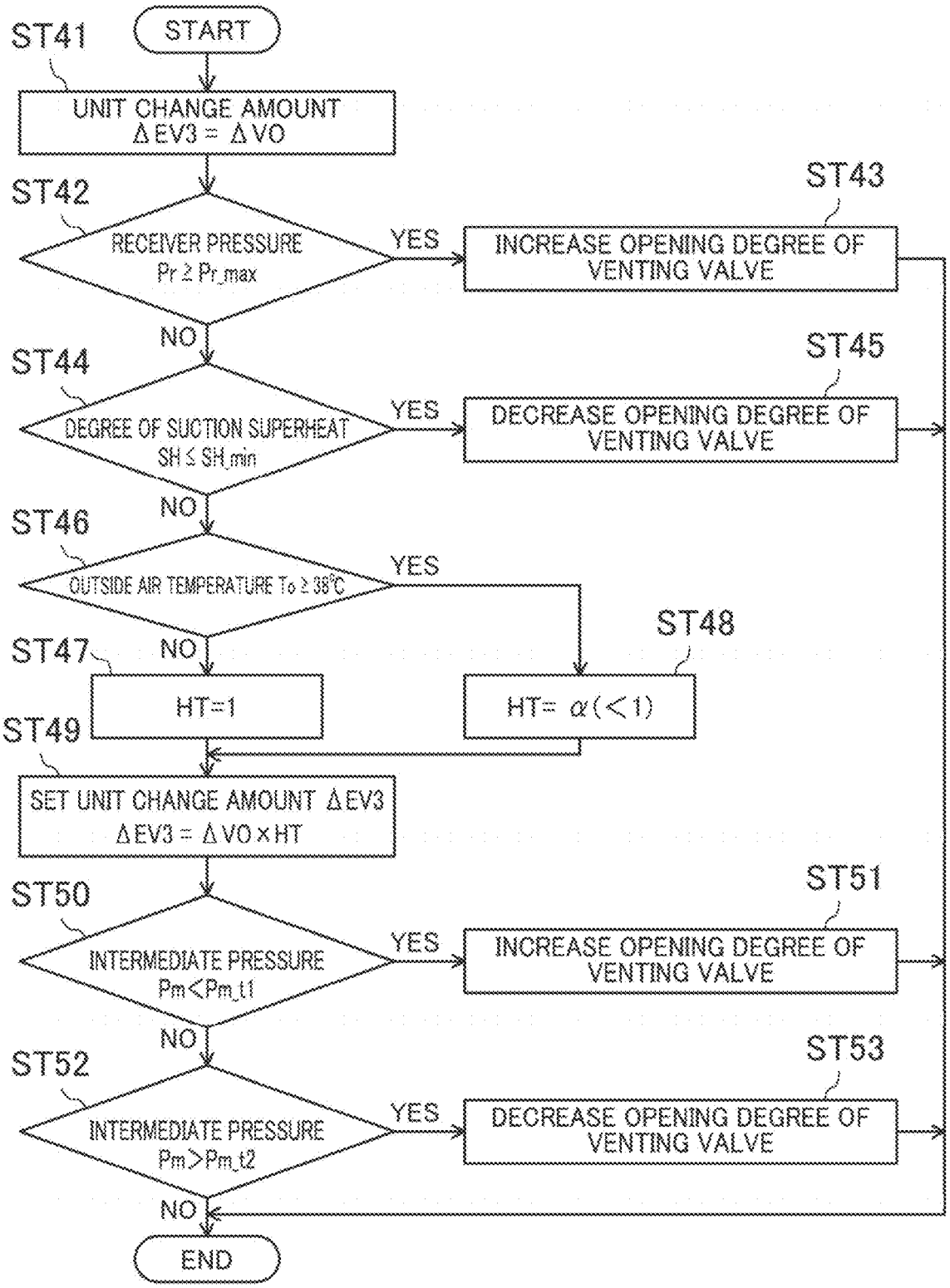
FIG. 13 is a flowchart of the control of the venting valve by the outdoor controller of the third embodiment.

The operation of the outdoor controller (131) of this embodiment controlling the venting valve (42) will be described with reference to the flowchart of FIG. 13. The outdoor controller (131) repeats the operation shown in FIG. 13 every predetermined time (e.g., every seconds). Note that the specific numerical values shown in this description are mere examples.

In the process of step ST41, the outdoor controller (131) sets the unit change amount ΔEV3 of the venting valve (42) to ΔVO (ΔEV3=ΔVO). ΔVO is a reference change amount of the opening degree of the electronic expansion valve. In this embodiment, ΔVO is 100 pulses. In the process of step ST41, the outdoor controller (131) of this embodiment sets the unit change amount ΔEV3 to 100 pulses. In the process of step ST41, the outdoor controller (131) may set the unit change amount ΔEV3 of the venting valve (42) to a value greater than ΔVO.

Next, in the process of step ST42, the outdoor controller (131) obtains the measurement value of the liquid-side pressure sensor (105) as the receiver pressure Pr. The outdoor controller (131) compares the obtained receiver pressure Pr with the upper limit value Pr_max of the receiver pressure. The outdoor controller (131) conducts the process of step ST43 if the condition that the receiver pressure Pr is equal to or higher than the upper limit value Pr_max (Pr≥Pr_max) is true, and conducts the process of step ST44 if the condition is not true.

In the process of step ST43, the outdoor controller (131) increases the opening degree of the venting valve (42) by the unit change amount ΔEV3 set in the process of step ST41. If the opening degree of the venting valve (42) increases, the flow rate of the gas refrigerant flowing out from the receiver (25) to the venting pipe (41) increases, and the receiver pressure Pr decreases.

In the process of step ST44, the outdoor controller (131) calculates the degree of superheat of the refrigerant sucked into the third compressors (23) (the degree of suction superheat SH). Similarly to the process of step ST29 in FIG. 12, the outdoor controller (131) obtains the measurement value of the intermediate pressure sensor (102) and the measurement value of the third suction temperature sensor (116), and calculates the degree of suction superheat SH using these obtained measurement values.

In the process of step ST44, the outdoor controller (131) compares the calculated degree of suction superheat SH with the lower limit value SH_min (e.g., 0° C.) of the degree of suction superheat SH. The outdoor controller (131) conducts the process of step ST45 if the condition that the degree of suction superheat SH is equal to or lower than the lower limit value SH_min (SH≤SH_min) is true, and conducts the process of step ST46 if the condition is not true.

In the process of step ST45, the outdoor controller (131) decreases the opening degree of the venting valve (42) by the unit change amount ΔEV3 set in the process of step ST41. If the opening degree of the venting valve (42) decreases, the flow rate of the gas refrigerant flowing out from the receiver (25) to the venting pipe (41) decreases, and the temperature of the refrigerant sucked into the third compressor (23) increases. Thus, the degree of suction superheat SH increases.

In the process of step ST46, the outdoor controller (131) obtains the measurement value of the outdoor air temperature sensor (121) as the outdoor air temperature To. The outdoor controller (131) compares the obtained outdoor air temperature To with a predetermined reference value (38° C. in this embodiment). Specifically, the outdoor controller (131) determines whether the condition that the outdoor air temperature To is 38° C. or higher is true.

If the outdoor air temperature To is lower than 38° C., the outdoor controller (131) conducts the process of step ST47 to employ HT=1. If the outdoor air temperature To is 38° C. or higher, the outdoor controller (131) conducts the process of step ST48 to employ HT=a. HT is a coefficient used to determine the unit change amount ΔEV3. α is a numerical value higher than 0 and lower than 1. In this embodiment, α=0.5 is employed.

If the process of step ST47 or step ST48 is completed, the outdoor controller (131) conducts the process of step ST49. In this process, the outdoor controller (131) sets the unit change amount ΔEV3 of the venting valve (42).

Specifically, the outdoor controller (131) sets the unit change amount ΔEV3 to ΔVO×HT (ΔEV3=ΔVO×HT). ΔVO is a reference change amount of the opening degree of the electronic expansion valve. In this embodiment, ΔVO is 100 pulses. Thus, the outdoor controller (131) of this embodiment sets the unit change amount ΔEV3 to 100 pulses if the outdoor air temperature To<38° C., and sets the unit change amount ΔEV3 to 50 pulses if the outdoor air temperature To≥38° C.

Next, in the process of step ST50, the outdoor controller (131) obtains the measurement value of the intermediate pressure sensor (102) as the intermediate pressure Pm. The outdoor controller (131) compares the obtained intermediate pressure Pm with the lower limit value Pm_t1 of the target range. The outdoor controller (131) conducts the process of step ST51 if the condition that the intermediate pressure Pm is lower than the lower limit value Pm_t1 (Pm<Pm_t1) is true, and conducts the process of step ST52 if the condition is not true.

In the process of step ST51, the outdoor controller (131) increases the opening degree of the venting valve (42) by the unit change amount ΔEV3 set in the process of step ST49. If the opening degree of the venting valve (42) increases, the pressure of the refrigerant sent from the venting pipe (41) to the third compressor (23) increases, and the pressure of the refrigerant sucked into the third compressor (23) (i.e., the intermediate pressure Pm) increases. If the opening degree of the venting valve (42) increases, the pressure of the refrigerant discharged from the third compressor (23) increases, and the high pressure of the refrigeration cycle increases.

In the process of step ST52, the outdoor controller (131) compares the obtained intermediate pressure Pm with the upper limit value Pm_t2 of the target range. If the condition that the intermediate pressure Pm is higher than the upper limit value Pm_t2 (Pm>Pm_t2) is true, the outdoor controller (131) conducts the process of step ST53.

In the process of step ST53, the outdoor controller (131) decreases the opening degree of the venting valve (42) by the unit change amount ΔEV3 set in the process of step ST49. If the opening degree of the venting valve (42) decreases, the pressure of the refrigerant sent from the venting pipe (41) to the third compressor (23) decreases, and the pressure of the refrigerant sucked into the third compressor (23) (i.e., the intermediate pressure Pm) decreases. If the opening degree of the venting valve (42) decreases, the pressure of the refrigerant discharged from the third compressor (23) decreases, and the high pressure of the refrigeration cycle decreases.

If the condition in the process of step ST52 is not true, the intermediate pressure Pm is in the target range. Thus, if this condition is not true, the outdoor controller (131) does not change the opening degree of the venting valve (42), and ends the control operation of the venting valve (42).

(2) Variations of Third Embodiment

Variations of the third embodiment will be described below.

(2-1) First Variation

The outdoor controller (131) of this embodiment may be configured to change both the unit change amount ΔEV1 of the opening degree of the first outdoor expansion valve (26) and the unit change amount ΔEV3 of the opening degree of the venting valve (42) based on the outdoor air temperature To as the high pressure index. The outdoor controller (131) of this variation adjusts the opening degree of the first outdoor expansion valve (26) in the same way the outdoor controller (131) of the first embodiment does.

(2-2) Second Variation

The outdoor controller (131) of this embodiment may be configured to change only the unit increase amount among the unit increase amount and the unit decrease amount of the opening degree of the venting valve (42) based on the outdoor air temperature To as the high pressure index.

If the opening degree of the venting valve (42) is increased, the flow rate of the refrigerant sent to the third compressor (23) through the venting pipe (41) increases, and as a result, the pressure of the refrigerant discharged from the third compressor (23) (the discharge pressure) increases. Thus, the outdoor controller (131) of this variation changes "the unit increase amount of the venting valve (42) employed when the outdoor air temperature To as the high pressure index is higher than the reference value" to a value smaller than "the unit increase amount of the venting valve (42) employed when the high pressure index is lower than the reference value." In contrast, the outdoor controller (131) of this variation keeps the unit decrease amount of the venting valve (42) constant regardless of the outdoor air temperature To as the high pressure index.

Fourth Embodiment

A fourth embodiment will be described below. The refrigeration apparatus (1) of this embodiment includes a modified version of the heat source circuit (11) of the refrigeration apparatus (1) of the first embodiment and does not include the air-conditioning unit (60) of the refrigeration apparatus (1) of the first embodiment. The refrigeration apparatus (1) of this embodiment performs a single-stage compression refrigeration cycle.

Figure 14:
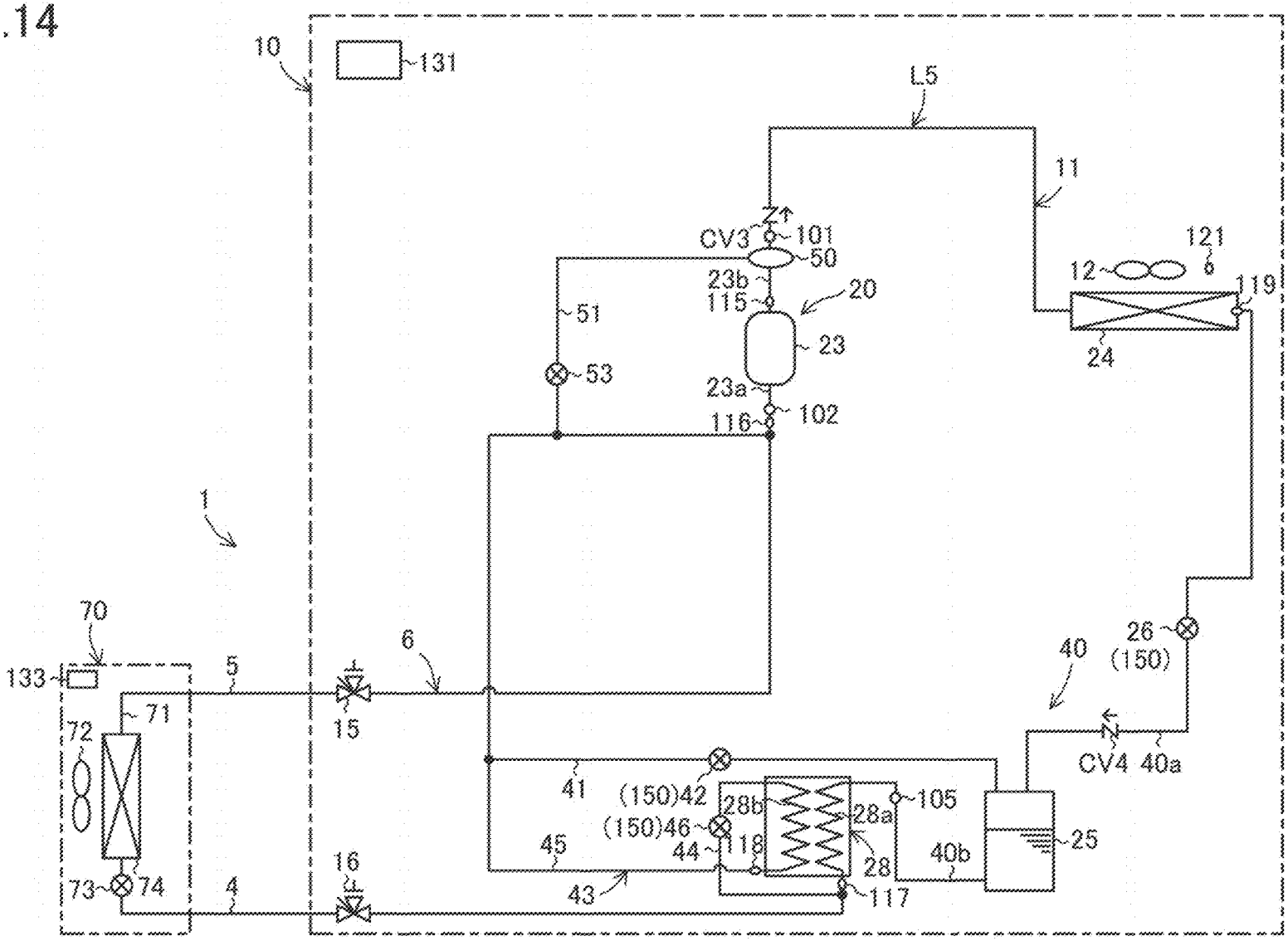
FIG. 14 is a piping system diagram of a refrigeration apparatus of a fourth embodiment.

As shown in FIG. 14, the compression unit (20) of this embodiment consists of only the third compressor (23). In the heat source circuit (11) of this embodiment, the flow path switching mechanism (30), the intermediate flow path (18), the intercooler (29), the second outdoor expansion valve (27), the first gas shut-off valve (13), and the first liquid shut-off valve (14) are omitted.

In the heat source circuit (11) of this embodiment, the third suction pipe (23*a*) of the third compressor (23) is connected to the second gas shut-off valve (15). The third discharge pipe (23*b*) of the third compressor (23) is connected to the outdoor heat exchanger (24). The first oil return pipe (51) is connected to the downstream flow path (45) of the injection flow path (43). The downstream flow path (45) of the injection flow path (43) is connected to the third suction pipe (23*a*) of the third compressor (23).

The outdoor controller (131) of this embodiment adjusts the opening degree of the first outdoor expansion valve (26) in the same way the outdoor controller (131) of the first embodiment does. The outdoor controller (131) of this embodiment may adjust the opening degree of the injection valve (46) in the same way the outdoor controller (131) of the second embodiment does. The outdoor controller (131) of this embodiment may adjust the opening degree of the venting valve (42) in the same way the outdoor controller (131) of the third embodiment does.

Fifth Embodiment

A fifth embodiment will be described below. The refrigeration apparatus (1) of this embodiment includes a modified version of the heat source circuit (11) of the refrigeration apparatus (1) of the first embodiment and does not include the refrigeration-facility unit (70) of the refrigeration apparatus (1) of the first embodiment. The refrigeration apparatus (1) of this embodiment performs a single-stage compression refrigeration cycle.

Figure 15:
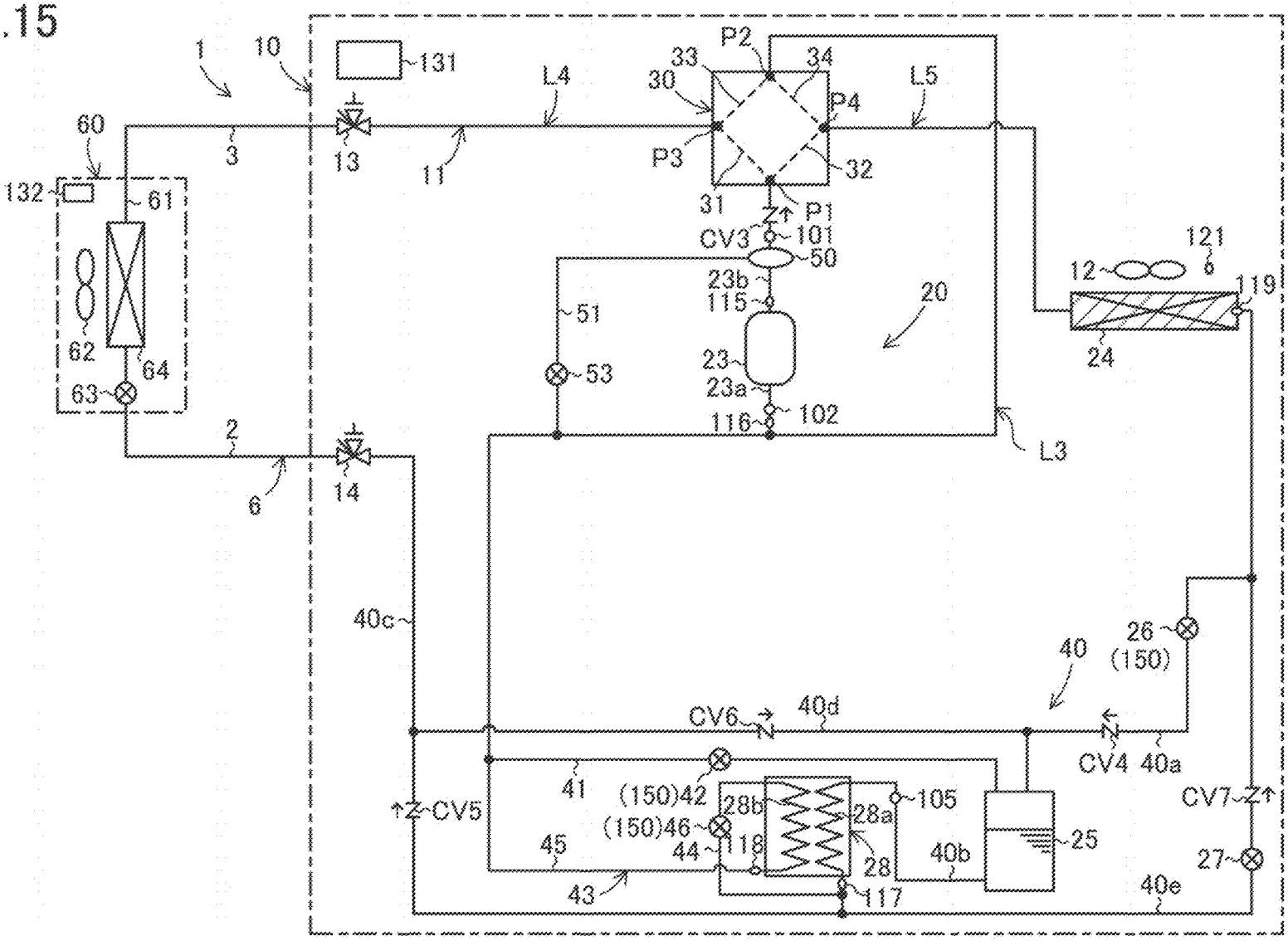
FIG. 15 is a piping system diagram of a refrigeration apparatus of a fifth embodiment.
Figure 16:
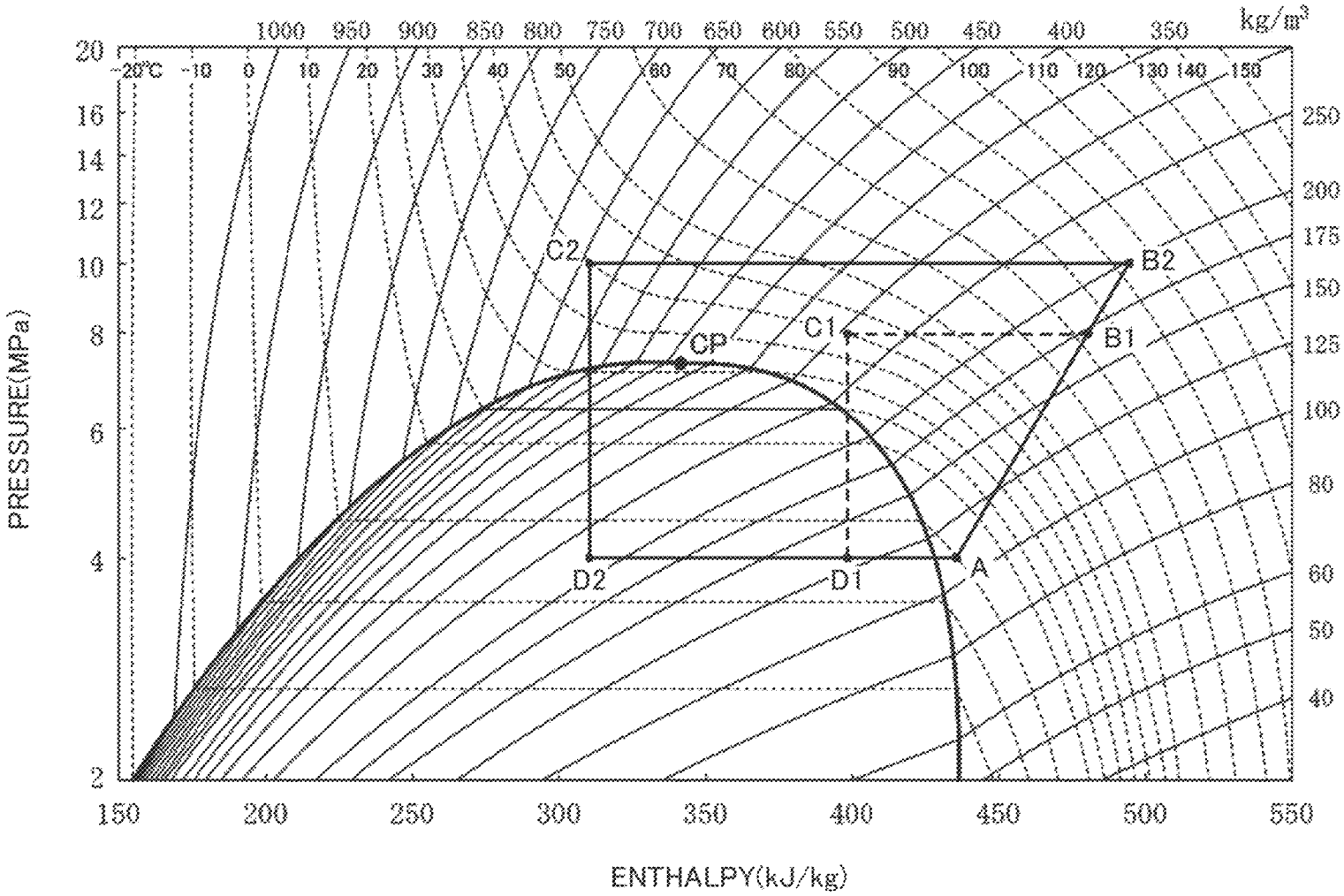
FIG. 16 is a Mollier diagram (pressure-enthalpy diagram) showing a refrigeration cycle.

As shown in FIG. 15, the compression unit (20) of this embodiment consists of only the third compressor (23). In the heat source circuit (11) of this embodiment, the intermediate flow path (18), the intercooler (29), the second gas shut-off valve (15), and the second liquid shut-off valve (16) are omitted.

In the heat source circuit (11) of this embodiment, the suction portion of the third compressor (23) is connected to the second port (P2) of the flow path switching mechanism (30) via the suction line (L3). The suction line (L3) of this embodiment includes the third suction pipe (23*a*) connected to the suction portion of the third compressor (23). Similarly to the first embodiment, the third discharge pipe (23*b*) of the third compressor (23) is connected to the first port (P1) of the flow path switching mechanism (30). The first oil return pipe (51) is connected to the downstream flow path (45) of the injection flow path (43). The downstream flow path (45) of the injection flow path (43) is connected to the third suction pipe (23*a*) of the third compressor (23).

The outdoor controller (131) of this embodiment adjusts the opening degree of the first outdoor expansion valve (26) in the same way the outdoor controller (131) of the first embodiment does. The outdoor controller (131) of this embodiment may adjust the opening degree of the injection valve (46) in the same way the outdoor controller (131) of the second embodiment does. The outdoor controller (131) of this embodiment may adjust the opening degree of the venting valve (42) in the same way the outdoor controller (131) of the third embodiment does.

OTHER EMBODIMENTS

The heat source unit (10) of each embodiment may be arranged according to the following variations.

(1) First Variation

The outdoor controller (131) of each embodiment is configured so that the coefficient HT used to determine the unit change amount of the refrigerant control valve (150) is $\alpha$ ($0<\alpha<1$) if the outdoor air temperature To as the high pressure index is equal to or higher than the reference value (To≥the reference value). In contrast, the outdoor controller (131) of each embodiment may be configured so that the coefficient HT is $\alpha$ if the outdoor air temperature To as the high pressure index is higher than the reference value (To>the reference value).

(2) Second Variation

The outdoor controller (131) of each embodiment may be configured to use a physical quantity other than the outdoor air temperature To as the high pressure index. Specifically, the outdoor controller (131) of each embodiment may be configured to use the discharge pressure, which is the measurement value of the high pressure sensor (101), as the high pressure index. Further, the outdoor controller (131) of each embodiment may be configured to use the intermediate pressure, which is the measurement value of the intermediate pressure sensor (102), as the high pressure index.

(3) Third Variation

The outdoor controller (131) of each embodiment is configured to increase or decrease the opening degree of the refrigerant control valve (150), which is an electronic expansion valve, by one step (i.e., by the unit change amount). However, the outdoor controller (131) does not always need to change the opening degree of the refrigerant control valve (150) by one step. The outdoor controller (131) of each embodiment may be configured to change the opening degree of the refrigerant control valve (150) by a plurality of steps at a time, for example, if the difference between the physical quantity used for the control and the target value is large.

(4) Fourth Variation

In the heat source unit (10) of each embodiment, each of the first outdoor expansion valve (26), the injection valve (46), and the venting valve (42) is a refrigerant control valve (150) where if its opening degree is changed, the high pressure of the refrigeration cycle changes.

Thus, the outdoor controller (131) of each embodiment may be configured to control the opening degree of the first outdoor expansion valve (26), the injection valve (46), or the venting valve (42) based on the high pressure of the refrigeration cycle (specifically, the measurement value of the high pressure sensor (101)). In this case, the outdoor controller (131) adjusts the opening degree of the first outdoor expansion valve (26), the injection valve (46), or the venting valve (42) so that the high pressure of the refrigeration cycle is as high as possible in a range lower than the upper limit pressure.

While the embodiments and the variation thereof have been described above, it will be understood that various changes in form and details may be made without departing from the spirit and scope of the claims. The elements according to the embodiments, the variations thereof, and the other embodiments may be combined and replaced with each other. In addition, the expressions "first", "second", "third", in the specification and the claims are used to distinguish the terms to which these expressions are given, and do not limit the number or order of the terms.

INDUSTRIAL APPLICABILITY

As described above, the present disclosure is useful for a heat source unit and a refrigeration apparatus.

DESCRIPTION OF REFERENCE CHARACTERS

1 Refrigeration Apparatus
10 Heat Source Unit
23 Third Compressor (Compressor)
24 Outdoor Heat Exchanger (Heat-Source-Side Heat Exchanger)
25 Receiver
26 First Outdoor Expansion Valve (First Expansion Valve)
28 Subcooling Heat Exchanger
41 Venting Pipe
42 Venting Valve (Third Expansion Valve)
43 Injection Flow Path (Injection Pipe)
46 Injection Valve (Second Expansion Valve)
60 Air-Conditioning Unit (Utilization-Side Unit)
70 Refrigeration-Facility Unit (Utilization-Side Unit)
131 Outdoor Controller (Controller)
150 Refrigerant Control Valve

The invention claimed is:

1. A heat source unit connected to a utilization-side unit and configured to perform a refrigeration cycle by circulating a refrigerant between the heat source unit and the utilization-side unit, the heat source unit comprising:

a compressor;

a heat-source-side heat exchanger;

a refrigerant control valve of which an opening degree is variable to control a flow of the refrigerant, where if the opening degree is changed, a high pressure of the refrigeration cycle changes; and a controller configured to change the opening degree of the refrigerant control valve in a stepwise manner, wherein an amount of change by one step in the opening degree of the refrigerant control valve obtained when the controller controls the refrigerant control valve is a unit change amount, a physical quantity indicating the high pressure of the refrigeration cycle is a high pressure index, a value of the high pressure index indicating that the high pressure of the refrigeration cycle is higher than a critical pressure of the refrigerant is a reference value, and the controller changes the unit change amount employed when the high pressure index is higher than the reference value to a value lower than the unit change amount employed when the high pressure index is lower than the reference value.

2. The heat source unit of claim 1, wherein the refrigerant control valve is a first expansion valve configured to decompress a refrigerant flowing out of the heat-source-side heat exchanger functioning as a radiator.

3. The heat source unit of claim 2, wherein the unit change amount by which the opening degree of the refrigerant control valve is decreased is a unit decrease amount, and the controller changes the unit decrease amount employed when the high pressure index is higher than the reference value to a value lower than the unit decrease amount employed when the high pressure index is lower than the reference value.

4. The heat source unit of claim 3, wherein the unit change amount by which the opening degree of the refrigerant control valve is increased is a unit increase amount, and the controller changes the unit increase amount employed when the high pressure index is higher than the reference value to a value lower than the unit increase amount employed when the high pressure index is lower than the reference value.

5. The heat source unit of claim 1, further comprising:

an injection pipe configured to send part of the refrigerant flowing out of the heat-source-side heat exchanger functioning as a radiator to the compressor; and a subcooling heat exchanger configured to exchange heat between the refrigerant flowing out of the heat-source-side heat exchanger functioning as a radiator and the refrigerant flowing through the injection pipe, thereby cooling the refrigerant flowing out of the heat-source-side exchanger functioning as a radiator, wherein the refrigerant control valve is a second expansion valve that is disposed upstream of the subcooling heat exchanger in the injection pipe and that is configured to reduce the pressure of the refrigerant flowing through the injection pipe.

6. The heat source unit of claim 1, further comprising:

a first expansion valve configured to decompress a refrigerant flowing out of the heat-source-side heat exchanger functioning as a radiator;

a receiver into which a refrigerant having passed through the first expansion valve flows; and a venting pipe configured to send a gas refrigerant in the receiver to the compressor, wherein the refrigerant control valve is a third expansion valve provided in the venting pipe and configured to decompress a refrigerant.

7. The heat source unit of claim 5, wherein the unit change amount by which the opening degree of the refrigerant control valve is increased is a unit increase amount, and the controller changes the unit increase amount employed when the high pressure index is higher than the reference value to a value lower than the unit increase amount employed when the high pressure index is lower than the reference value.

8. The heat source unit of claim 7, wherein the unit change amount by which the opening degree of the refrigerant control valve is decreased is a unit decrease amount, and the controller changes the unit decrease amount employed when the high pressure index is higher than the reference value to a value lower than the unit decrease amount employed when the high pressure index is lower than the reference value.

9. The heat source unit of claim 6, wherein the unit change amount by which the opening degree of the refrigerant control valve is increased is a unit increase amount, and the controller changes the unit increase amount employed when the high pressure index is higher than the reference value to a value lower than the unit increase amount employed when the high pressure index is lower than the reference value.

10. The heat source unit of claim 9, wherein the unit change amount by which the opening degree of the refrigerant control valve is decreased is a unit decrease amount, and the controller changes the unit decrease amount employed when the high pressure index is higher than the reference value to a value lower than the unit decrease amount employed when the high pressure index is lower than the reference value.

11. The heat source unit of claim 1, wherein the heat-source-side heat exchanger is a heat exchanger configured to exchange heat between the refrigerant and outdoor air, and the high pressure index is a temperature of outdoor air.

12. A refrigeration apparatus, comprising:

the heat source unit of claim 1; and a utilization-side unit connected to the heat source unit via a pipe.

* * * * *